US012268921B2

(12) United States Patent
Koifman

(10) Patent No.: US 12,268,921 B2
(45) Date of Patent: Apr. 8, 2025

(54) SYSTEM AND METHOD FOR A MOBILE EXERCISE DEVICE

(71) Applicant: Sharon Koifman, Westmount (CA)

(72) Inventor: Sharon Koifman, Westmount (CA)

( * ) Notice: Subject to any disclaimer, the term of this patent is extended or adjusted under 35 U.S.C. 154(b) by 283 days.

(21) Appl. No.: 17/971,531

(22) Filed: Oct. 21, 2022

(65) Prior Publication Data

US 2023/0125536 A1 Apr. 27, 2023

Related U.S. Application Data

(60) Provisional application No. 63/270,226, filed on Oct. 21, 2021.

(51) Int. Cl.

*A63B 21/00* (2006.01)
*A63B 24/00* (2006.01)
*A63B 71/06* (2006.01)

(52) U.S. Cl.

CPC ..... *A63B 21/4007* (2015.10); *A63B 21/154* (2013.01); *A63B 24/0087* (2013.01); *A63B 71/0622* (2013.01); *A63B 2024/009* (2013.01); *A63B 2071/0666* (2013.01)

(58) Field of Classification Search

CPC ..... A63B 21/4007; A63B 21/154; A63B 24/0087; A63B 71/0622; A63B 2024/009; A63B 2071/0666; A63B 21/023; A63B 2071/0655; A63B 2209/08; A63B 2209/10; A63B 2225/20; A63B 2225/50; A63B 21/153; A63B 21/4035; A63B 21/4043; A63B 2024/0096; A63B 21/0552; A63B 23/03541

See application file for complete search history.

(56) References Cited

U.S. PATENT DOCUMENTS 5,577,981 A * 11/1996 Jarvik ..... A63B 24/00 482/4
6,135,928 A * 10/2000 Butterfield ..... G06F 3/011 482/69
6,152,854 A * 11/2000 Carmein ..... A63G 31/16 198/779
2014/0111424 A1* 4/2014 Goetgeluk ..... G06F 3/011 345/156
2022/0096897 A1* 3/2022 Fung ..... A63F 13/22
2022/0276697 A1* 9/2022 Saunders ..... G06F 1/163

(Continued)

*Primary Examiner* — Andrew S Lo

(74) *Attorney, Agent, or Firm* — AdamsIP, LLC; Edward Brinkley Garner, III; James Hunter Adams

(57) ABSTRACT

A mobile exercise device configured to enhance virtual reality experiences is provided. The system generally comprises a harness, top supports, bottom-carrying arms, resistance elements, and attachment elements secured to said resistance elements. In some preferred embodiments, a mechanical arm and/or top-carrying arm may be used to change the position of the resistance elements about a user. The resistance elements are preferably secured to a glove worn by a user, allowing for resistance in multiple directions. In one preferred embodiment, a control system may be used to adjust the tension of the resistance elements. In another embodiment, the system may be configured to operably connect to a gaming system, wherein an actuator operably connected to said resistance elements is responsible for adjusting tension based on actions by a user within a digital environment.

19 Claims, 14 Drawing Sheets

(56) References Cited

U.S. PATENT DOCUMENTS

2023/0321510 A1* 10/2023 Magalhaes ..... A63B 69/0066
434/60
2023/0398426 A1* 12/2023 McKay ..... H04N 13/332

* cited by examiner

SYSTEM AND METHOD FOR A MOBILE EXERCISE DEVICE

CROSS REFERENCES

This application claims priority to U.S. Provisional Application Ser. No. 63/270,226, filed on Oct. 21, 2021, wherein said application is incorporated herein in its entirety by reference.

FIELD OF THE INVENTION

The subject matter of the present disclosure refers generally to a mobile exercise device configured to enhance exercise in a digital environment.

BACKGROUND

Physical activity can be an enjoyable experience that enhances one's life in multiple ways. Consistently participating in physical activity can improve health by helping to reduce excess body weight, especially when combined with healthy eating habits. And by making physical activity routine, one can expect numerous health benefits, including, but not limited to, a decrease in risk of high blood pressure/type 2 diabetes, increased circulation, reduced stress/anxiety, improved sleep quality, increases range of motion, etc. However, participating in physical activity can sometimes be difficult, and simply leaving one's residence can often take significant motivation. This is especially true when weather conditions and climate make exercise outside difficult or when poor air quality could adversely affect those participating in physical activity outdoors. A traditional solution to this is to create an indoor environment suitable for participating in physical activity indoors; however, the pandemic caused many facilities dedicated to indoor exercise, such as gyms and indoor sports facilities, to close for extended periods of time because of public health concerns. And a not insignificant portion of the population is considered vulnerable to COVID-19, resulting in many unable to return to their pre-pandemic, indoor exercise routine.

Virtual reality (VR) exercise applications have become increasingly popular, and many people are discovering how VR can be used to create/enhance an indoor exercise routine. This increase in popularity is not only due to the quarantine but also because of the unique experiences that virtual reality can provide. In fact, some virtual reality exercise applications present exercise in ways that disguise the exercise as games, resulting in users of virtual reality not even realizing that they are getting a good physical workout while engaging in the VR experience. For instance, some virtual reality applications are configured to pair with a rower and present a virtual reality environment that makes the user feel like they are rowing on the water in an exotic outdoor location. Other virtual reality applications are not meant for exercise at all but nevertheless provide an excellent workout when played by a user due to the activities required for said virtual reality application. For instance, boxing in virtual reality can provide a high intensity cardiovascular workout even though the user may not be using the virtual reality boxing application for exercise purposes. For instance, fantasy games that use bows, swords/shields, and other melee weapon configurations can also be exercise intensive due to the action of swinging the sword and/or holding and repeatedly shooting said bow over a period of time.

However, exercise in virtual reality is incredibly inefficient. Unless workout equipment is somehow paired with a VR headset/application, there is often very little resistance for any muscles being engaged. Further, existing virtual reality video games tend to be more suited for exercise involving certain specific body parts and muscles such as the shoulders, chest, and quadriceps. Existing virtual reality video games, however, are not well-suited for exercise involving certain other body parts and muscles such as, for example, muscles in the back and abdominal regions. Prior art in this field focuses on mostly providing resistance in a single direction such as when a user pushes their hands outward from the body, which works the muscle groups in only a single direction. Further, the design of this equipment often results in discomfort due to the resistance elements, commonly made of elastic, being pulled across the wrists and forearms, causing abrasion and discomfort. As a result of this discomfort, users may stop using the equipment with virtual reality all together. Additionally, some users of virtual reality naively attach weights not designed to be used with virtual reality to their outer extremities in hopes of getting a better workout in virtual reality; however, increasing weight in this manner can easily result in injuries such as hyper extended elbows and rotator cuff tears. This is particularly a danger for those who secure weights to their arms and/or hands when using virtual reality boxing applications.

Accordingly, there is a need in the art for a mobile exercise device that is compatible with virtual reality headsets and can be used to target a full range of muscles in multiple directions in order to provide a more complete workout as well as to enhance the virtual reality experience.

SUMMARY

A mobile exercise device configured to enhance virtual reality experiences is provided. In one aspect, the system of the present disclosure is configured to provide resistance to enhance workouts performed in a virtual reality environment. In another aspect, the system is configured to enhance the virtual reality experience by providing more realistic action. In yet another aspect, the system is configured to pair with virtual reality headsets in way that virtual reality applications of the system can manipulate the resistance in order to provide more realism to a virtual reality environment. In yet another aspect, the system is configured to reduce the chance of injury by providing resistance in a way that does not increase the chance of hyperextension. Generally, the system of the present disclosure is configured to provide resistance in a way that results in a full body workout when paired with a virtual reality application that involves movement.

The system generally comprises a harness, top supports, bottom-carrying arms, resistance elements, and attachment elements secured to said resistance elements. The harness comprises a textile component, backrest, and a plurality of straps. In a preferred embodiment, the plurality of straps may be used by a user to secure said textile component about the user's waist and shoulders in order to fasten said textile component to the user's person. The plurality of straps may comprise at least one fastening element, which enable a user to secure the textile component to their person. Devices that may act as the fastening element include, but are not limited to, rings, buckles, clasps, or any combination thereof.

In one preferred embodiment, the harness may comprise four rings, wherein a first ring is attached to a left shoulder region of said harness, a second ring is attached to a right shoulder region of said harness, a third ring is attached to a left hip region of said harness, and a fourth ring is attached to a right hip region of said harness. A first end of a resistance element may be secured to said rings and a second end of said resistance element may comprise an attachment element so that a user may secure the resistance elements to their person or a controller for physical activity. In another preferred embodiment, the harness may comprise two rings secured to said left shoulder region and said right shoulder region of the harness. Carabiners secured to each ring may be used to secure resistance elements thereto, which may then be secured to the user and/or a controller. Rings secured to a harness may be detachable from, and reattachable to, the harness. As such, the total number of rings attached to the harness may be readily increased or decreased as necessary or appropriate depending upon the nature of the physical activity that the subject may be engaging in.

The top supports and bottom-carrying arms of the system are preferably secured to the back of the textile component via the backrest. The backrest assembly preferably comprises a backplate, padding, resistance element adjustment mechanism, and support. In one preferred embodiment, the resistance elements are secured to the backrest in a way such that resistance of the resistance elements may be adjusted via the resistance element adjustment mechanism. The bottom carrying arm is preferably laterally adjustable in way that allows a user to adjust the angle in which resistance is applied by resistance elements supported by said bottom carrying arm. The top supports are preferably configured to support top-carrying arms and/or mechanical arms, which may also be used to adjust the angle in which resistance is applied to a user using the system.

Top-carrying arms and mechanical arms may be removably secured to the top supports and are preferably configured to extend from portions of the harness. In a preferred embodiment, the top-carrying arms and mechanical arms extend from the portion of the harness that, when worn by a user, may be located approximately at the shoulder region and/or hip region. In some preferred embodiments, the mechanical arms may be more than five feet in length and possess the ability to swivel up to 270 degrees on the top support to attain different positions. The mechanical arm preferably comprises a clamping knob so that a user may lock it in a desired position. In other preferred embodiments, the mechanical arm may comprise a clamping knob so that a user may adjust the height of the mechanical arm above the shoulder.

The mechanical arms may be contoured so that they comprise a partial enclosure. Alternatively, said mechanical arms may comprise a cylinder having a diameter of two or more inches. In some preferred embodiments, mechanical arms may be removably secured to the bottom-carrying arms and may be configured to rotate downward so that the distal tip of the mechanical arm is directly adjacent to the user's knee. In some preferred embodiments, the mechanical arm may retain its range of motion while being used by a user. A user wearing the harness may aim the mechanical arm with one hand and pull the resistant band with the other to get the experience of a bow and arrow. In yet another preferred embodiment, a first arm of a user may be secured to a mechanical arm, allowing a user to grip a resistance element of said mechanical arm. The user may then be free to utilize his or her free arm (that which is unattached to the mechanical arm) to pull the resistance band in a way that mimics a bow and arrow.

The attachment element of the resistance elements may allow for the attachment of video game controller and/or gloves. When secured in this way, the controllers and/or gloves may act as the gripping mechanism necessary for the user to manipulate the resistance elements. Devices that may act as the resistance elements of the system may include, but are not limited to, resistance bands, flexible rods, magnets, spring/pully, or any combination thereof. In some preferred embodiments, the resistance elements may be secured to the ends of the mechanical arm, top-carrying arm, and or bottom-carrying arm distal from the harness. The resistance elements are preferably used by a user as a means to provide additional resistance training to the muscle groups of the upper body, including, but not limited to, biceps, triceps, brachioradialis, flexor/extensor carpi, deltoids, trapezius, rhomboid minor/major, latissimus dorsi, or any combination thereof. In a preferred embodiment, training in this manner may be conducted by the user holding at least one controller that is secured to said resistance elements and subsequently engaging in a VR application requiring movement from the user. Alternatively, the user may wear gloves that are secured to said resistance elements and subsequently engaging in said VR application.

In a preferred embodiment, the resistance element is a spring and pulley system. The spring and pully system may be secured to the back plate of the harness, which may enhance optimal range of motion for a subject wearing the harness. The resistance elements preferably extend from the spring and pully system to the rings, top support, top-carrying arm, bottom-carrying arm, and/or mechanical arms. The resistance elements may then extend from rings, top support, top-carrying arm, bottom-carrying arm, and/or mechanical arms to a controller and/or glove in order to maximize the range of motion. In some preferred embodiments, the spring and pully system may be incorporated into the mechanical arm to facilitate movement of the resistance band as actuated by the subject wearing the harness to which the mechanical arms are connected.

In some preferred embodiments, the mechanical arms may comprise a resistance element within a cavity of said mechanical arms. Said resistance element may extend the length of the mechanical arm, wherein hooks or other attachment means may be used to secure the resistance elements thereto. The cavity of the mechanical arm may be a partial enclosure or a complete enclosure. In one preferred embodiment, the resistance element of the mechanical arm comprises a spring and pulley system. In some preferred embodiments the resistance element of the harness may be configured to operate separate from that of the resistance element of the harness. Alternatively, the resistance element of the mechanical arms may be operably connected to the resistance element of the harness in order to work together to create a desired resistance. A knob may be used to adjust the amount of resistance applied by the resistance element. In some preferred embodiments, a control board of the system may control the amount of resistance applied by the resistance elements, wherein said control board is operably connected to a VR headset.

In embodiments comprising gloves, the gloves may comprise two straps for securing said glove on user's hand. The straps preferably comprise an attachment element, such as buckles, for securing the glove to the user's hands. At least one ring extending outward from the glove may be used to secure the resistance elements to the wrist of the user. In an alternative embodiment, gloves of the present disclosure may comprise a buckle having male and female sections configured to removably secure to one another. In some preferred embodiments of gloves comprising buckles, resistance elements may be configured in way to removably secure to said male or female section of said buckle of said glove via a male or female section of a buckle of said resistance element. In yet another preferred embodiment, the gloves may comprise one or more rings attached to, and protruding outwardly from, the gloves. A carabiner of the resistance elements may be configured to secure to said one or more rings. In other embodiments, a video game controller and/or a mechanical arm may be secured to the one or more rings of the gloves. The glove is preferably constructed of materials that facilitate the distribution of pressure across the glove. The glove may also comprise a high friction surface that will assist a user to grip objects while wearing said gloves.

In some preferred embodiments, the system may further comprise a control board, actuator operably connected to said control board, processor operably connected to said control board, and non-transitory computer-readable medium operably connected to said processor and containing instructions therein. The processor may be operably connected to a virtual reality headset and configured to transmit instructions from said virtual reality headset to said control board via a communication interface. Based off of the instructions, the control board may manipulate the actuator in way such that it manipulates the amount of resistance applied by the resistance elements. The instructions sent by the processor to the control board are preferably based on actions taken by the user within a VR environment displayed on said VR headset. Further, the system may be configured to adjust resistance elements so that resistance is applied asymmetrically or symmetrically to the user. By relaying instructions to the control board to cause the actuator to quickly change resistance, both asymmetrical and symmetrical training may be achieved with this system.

The foregoing summary has outlined some features of the system and method of the present disclosure so that those skilled in the pertinent art may better understand the detailed description that follows. Additional features that form the subject of the claims will be described hereinafter. Those skilled in the pertinent art should appreciate that they can readily utilize these features for designing or modifying other structures for carrying out the same purpose of the system and method disclosed herein. Those skilled in the pertinent art should also realize that such equivalent designs or modifications do not depart from the scope of the system and method of the present disclosure.

DESCRIPTION OF DRAWINGS

These and other features, aspects, and advantages of the present disclosure will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally. Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "comprises" and grammatical equivalents thereof are used herein to mean that other components, steps, etc. are optionally present. For example, a system "comprising" components A, B, and C can contain only components A, B, and C, or can contain not only components A, B, and C, but also one or more other components. As used herein, the term "resistance band" means a band used to induce muscle contraction. As used herein, the term "ring" means a round plane object whose boundary consists of points approximately equidistant from a fixed point. When used herein, "ring" should be interpreted as interchangeable with circle, loop, or other term with substantially the same meaning. When the term "ring" is used herein, the skilled artisan will appreciate, upon reading the complete disclosure herein, that other objects of a similar nature that are capable of serving substantially the same function, are also contemplated by, and intended to be included within, this disclosure.

Figure 1A:
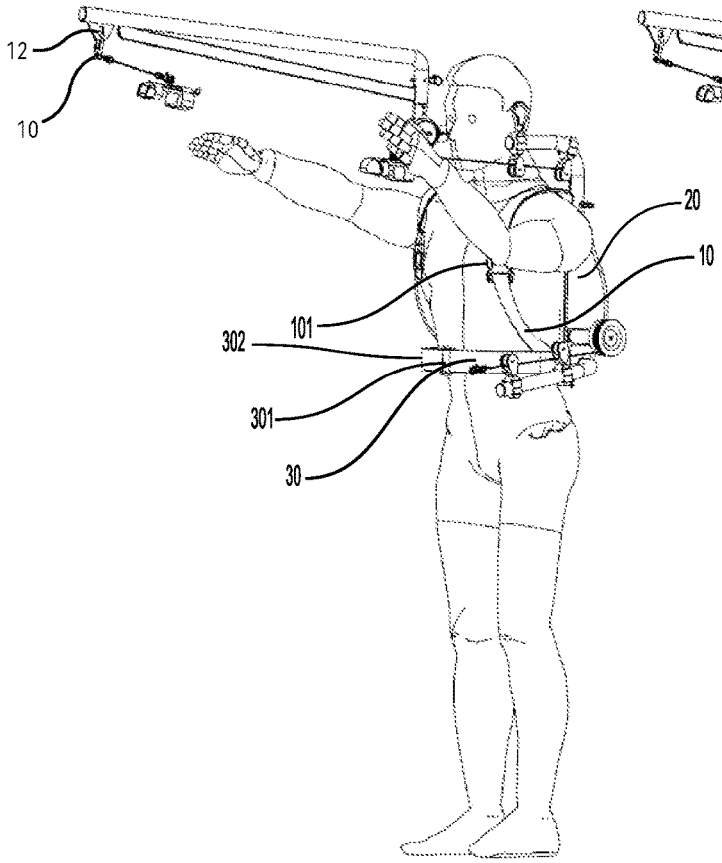
FIG. 1A illustrates a system embodying features consistent with the principles of the present disclosure.
Figure 1B:
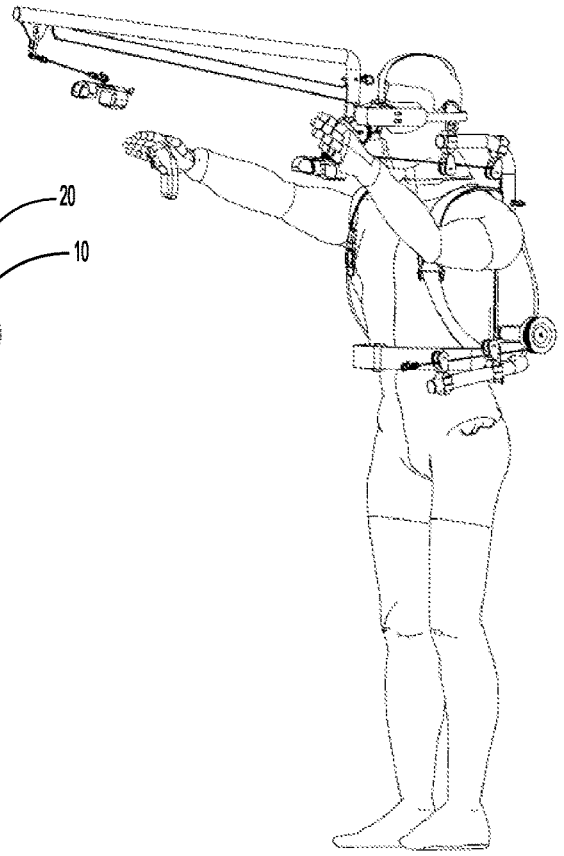
FIG. 1B illustrates a system embodying features consistent with the principles of the present disclosure.
Figure 2:
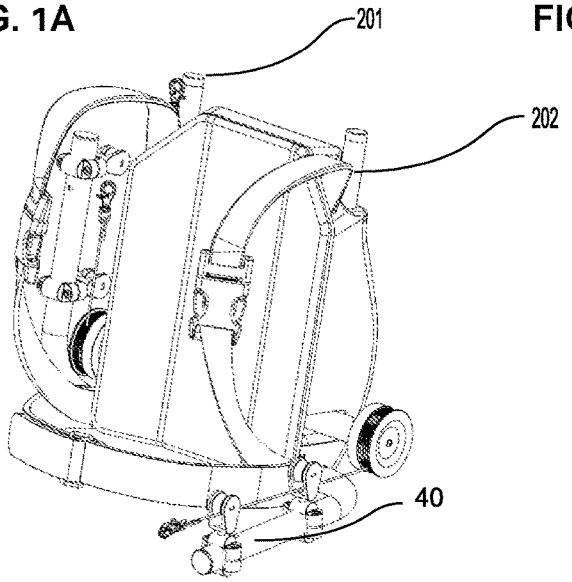
FIG. 2 illustrates a system embodying features consistent with the principles of the present disclosure.
Figure 3A:
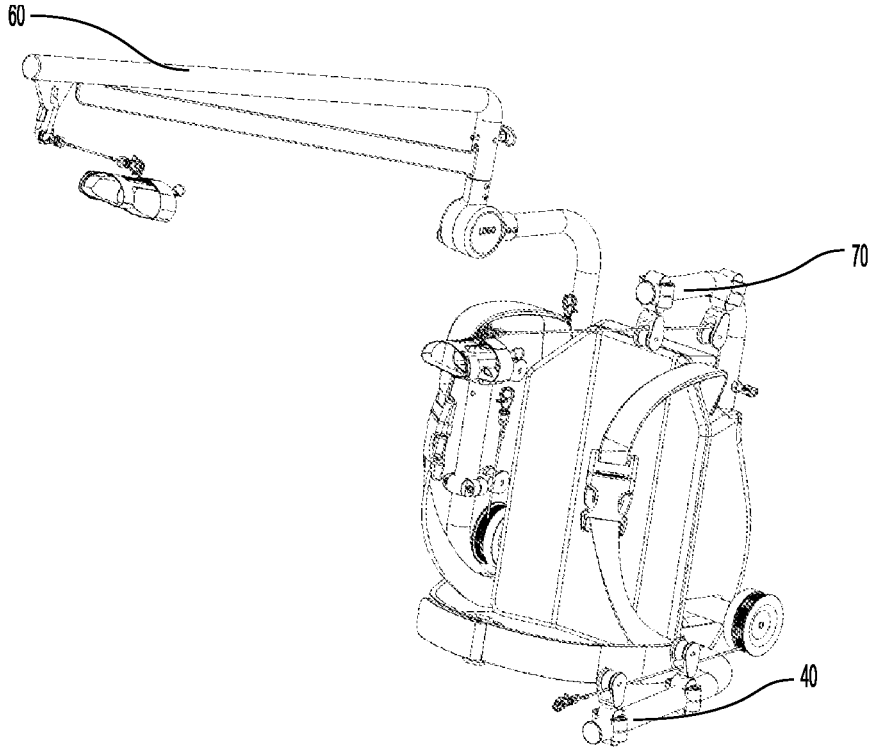
FIG. 3A illustrates a system embodying features consistent with the principles of the present disclosure.
Figure 3B:
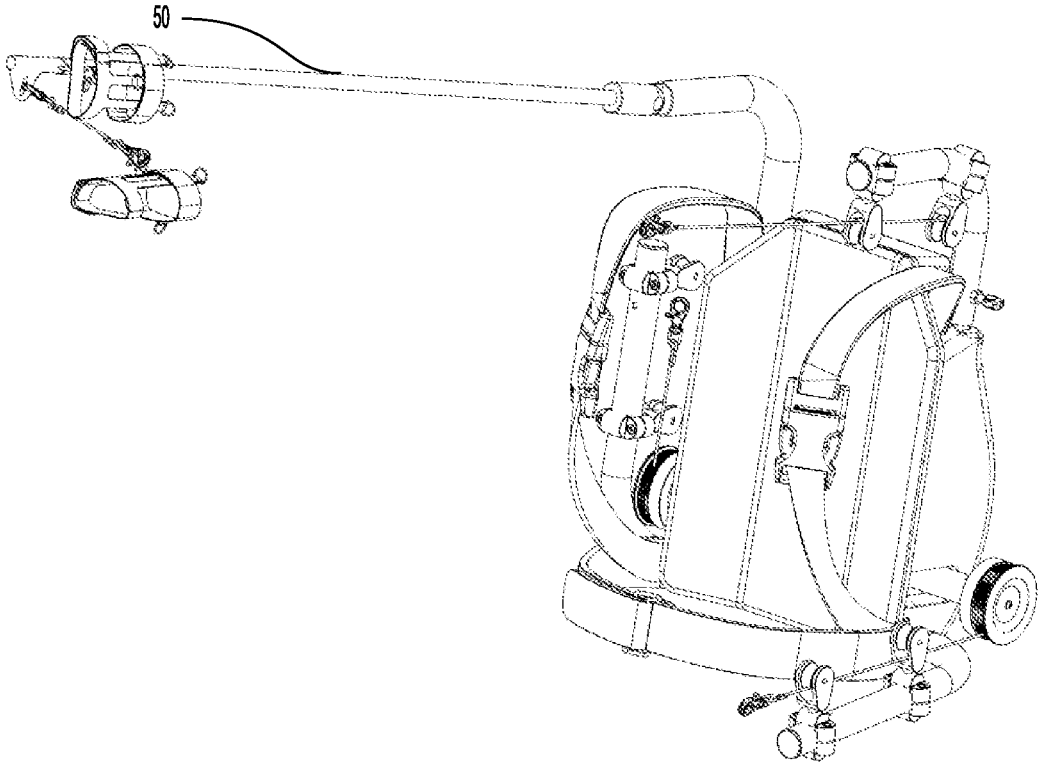
FIG. 3B illustrates a system embodying features consistent with the principles of the present disclosure.
Figure 4:
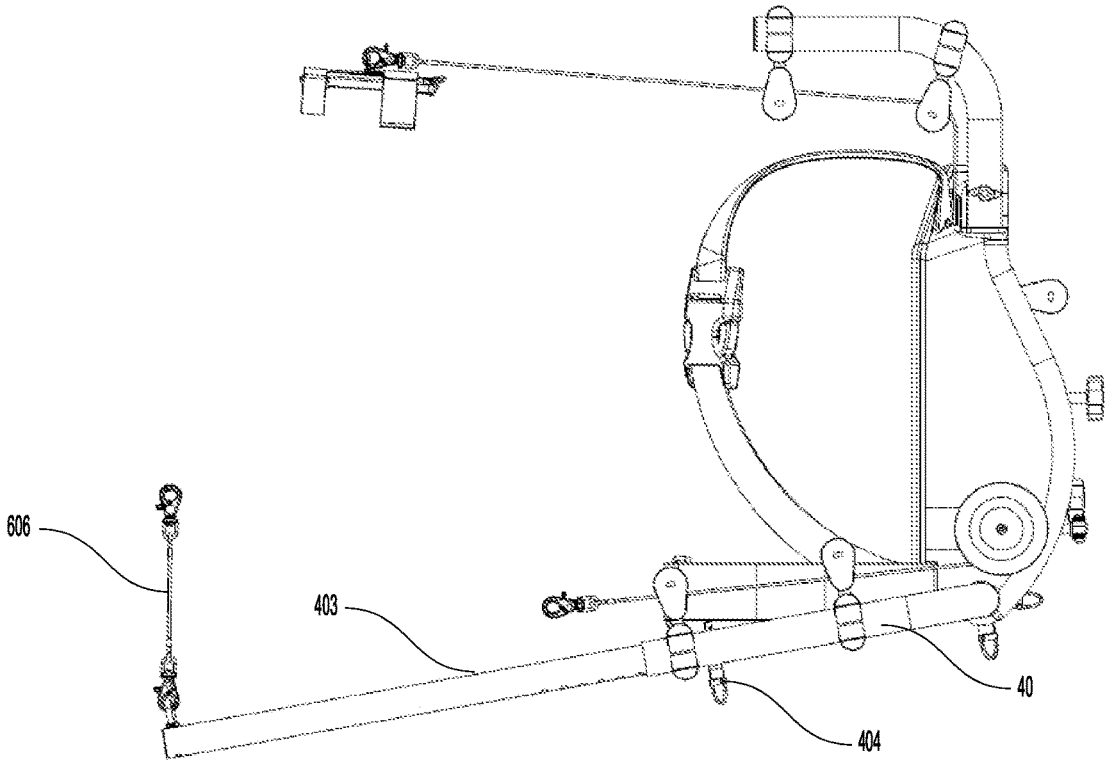
FIG. 4 illustrates a system embodying features consistent with the principles of the present disclosure.
Figure 5:
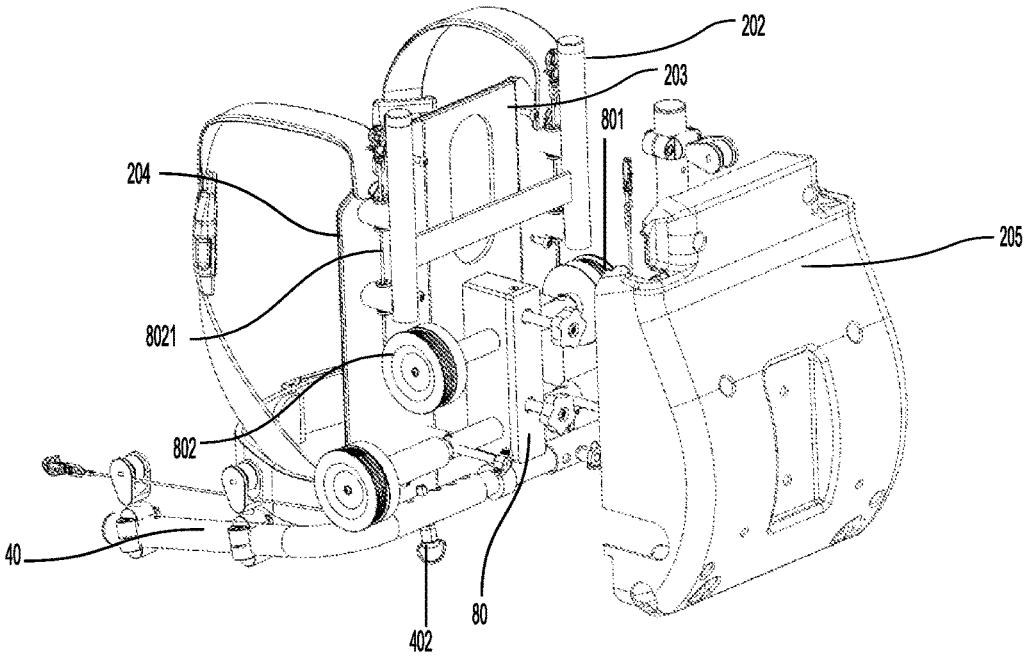
FIG. 5 illustrates a system embodying features consistent with the principles of the present disclosure.
Figure 6A:
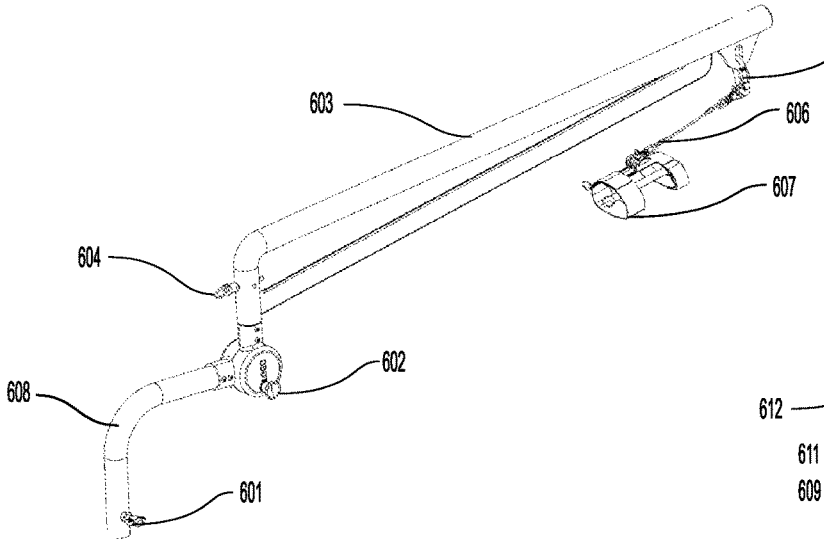
FIG. 6A illustrates a system embodying features consistent with the principles of the present disclosure.
Figure 6B:
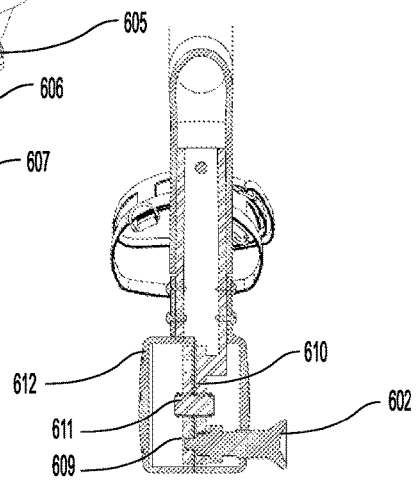
FIG. 6B illustrates a system embodying features consistent with the principles of the present disclosure.
Figure 7:
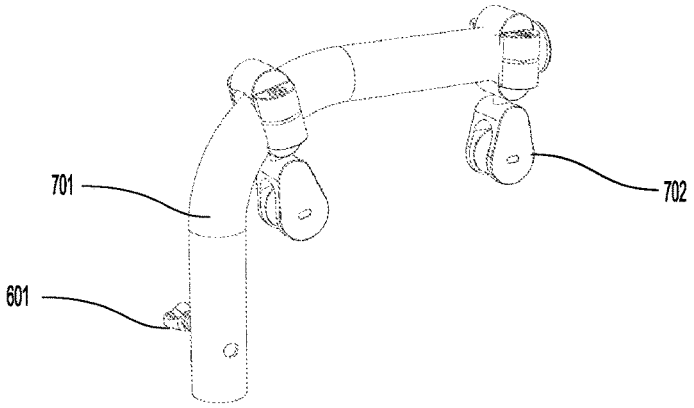
FIG. 7 illustrates a system embodying features consistent with the principles of the present disclosure.
Figure 8:
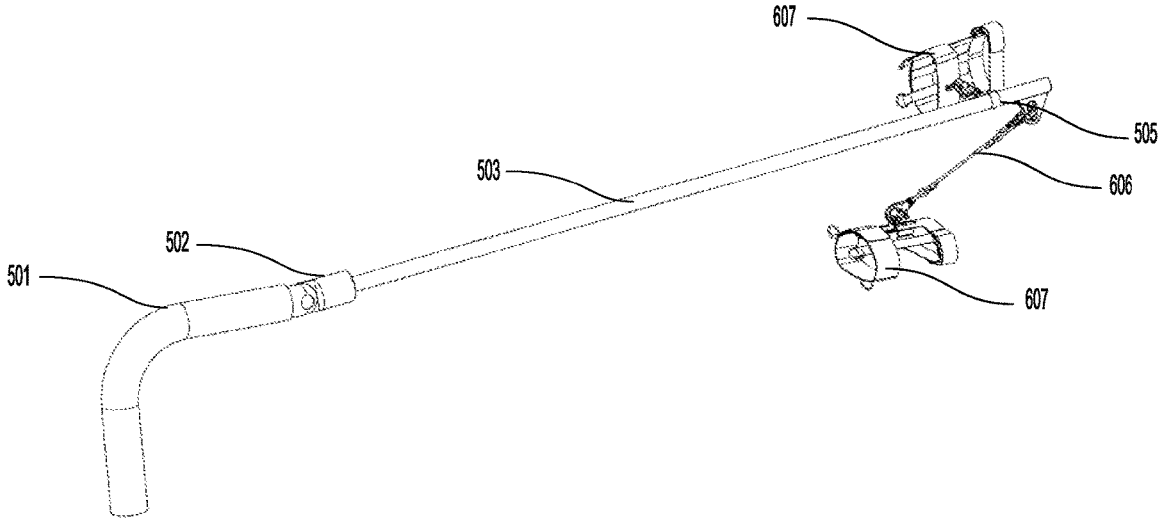
FIG. 8 illustrates a system embodying features consistent with the principles of the present disclosure.
Figure 9:
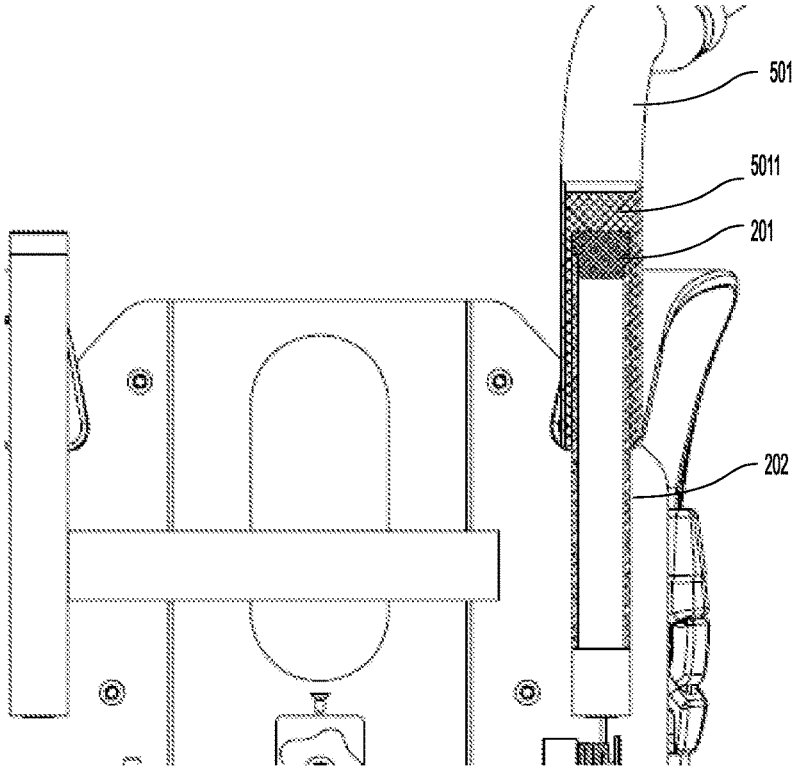
FIG. 9 illustrates a system embodying features consistent with the principles of the present disclosure.
Figure 10A:
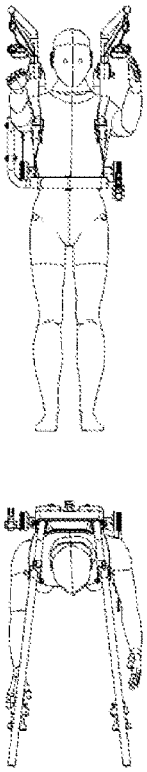
FIG. 10A illustrates a system embodying features consistent with the principles of the present disclosure being used within an environment.
Figure 10B:
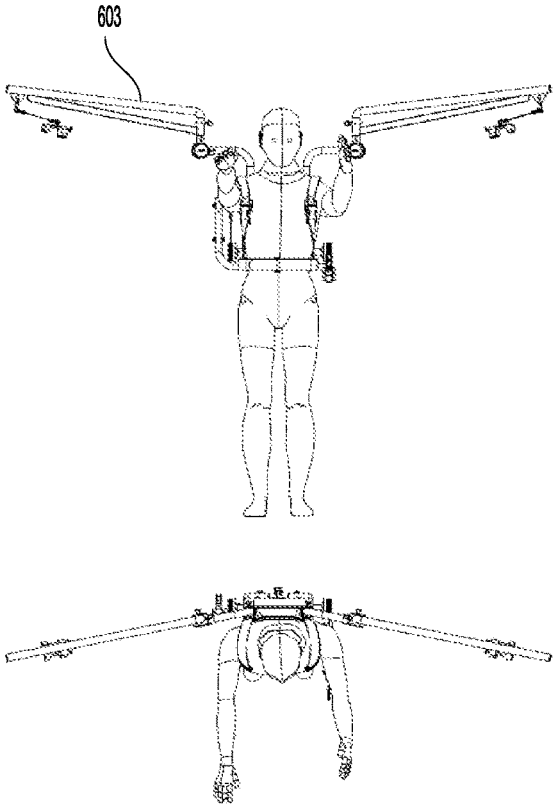
FIG. 10B illustrates a system embodying features consistent with the principles of the present disclosure being used within an environment.
Figure 10C:
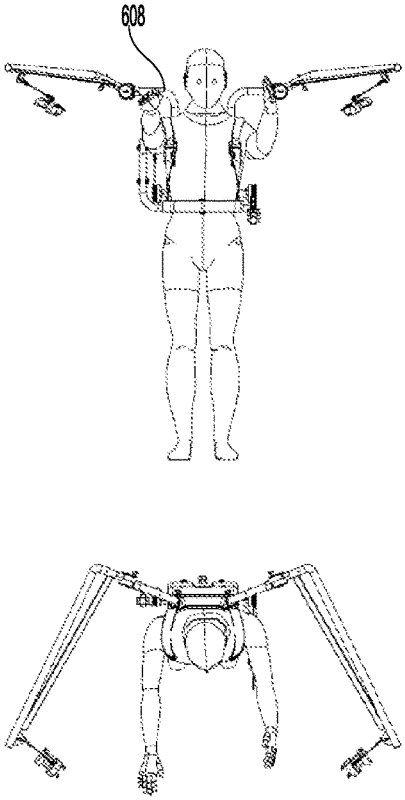
FIG. 10C illustrates a system embodying features consistent with the principles of the present disclosure being used within an environment.
Figure 11:
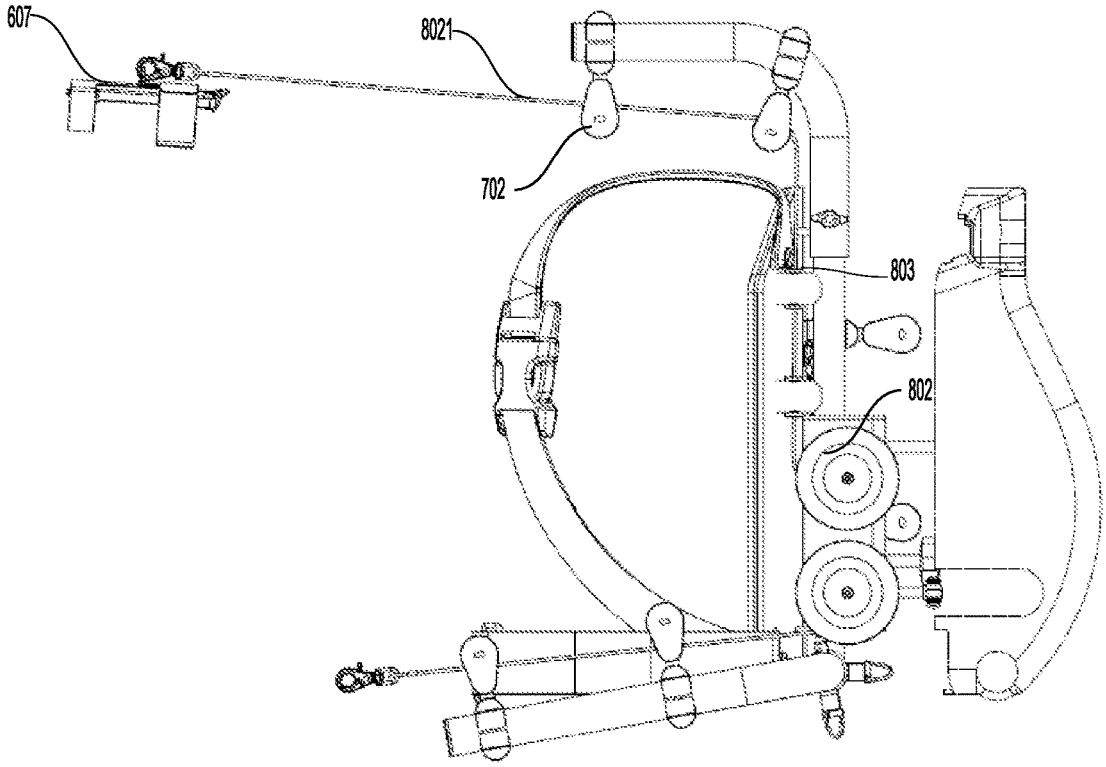
FIG. 11 illustrates a system embodying features consistent with the principles of the present disclosure being used within an environment.
Figure 12:
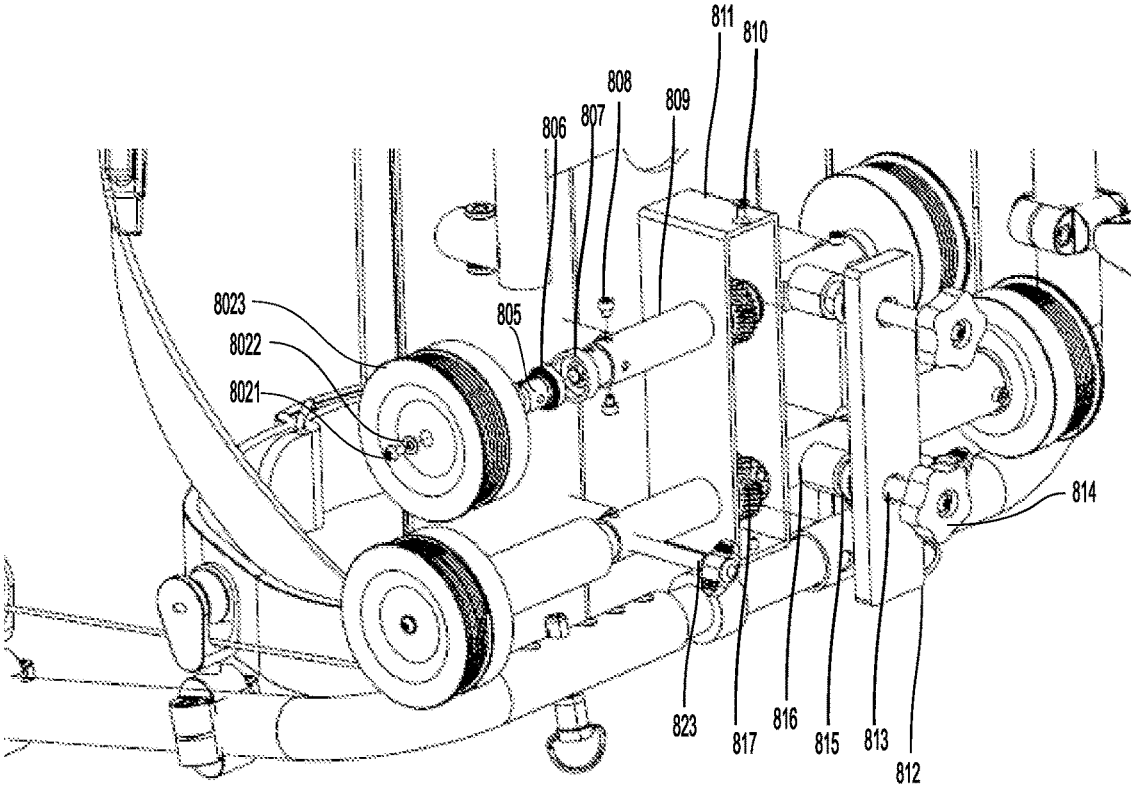
FIG. 12 illustrates a system embodying features consistent with the principles of the present disclosure being used within an environment.
Figure 13:
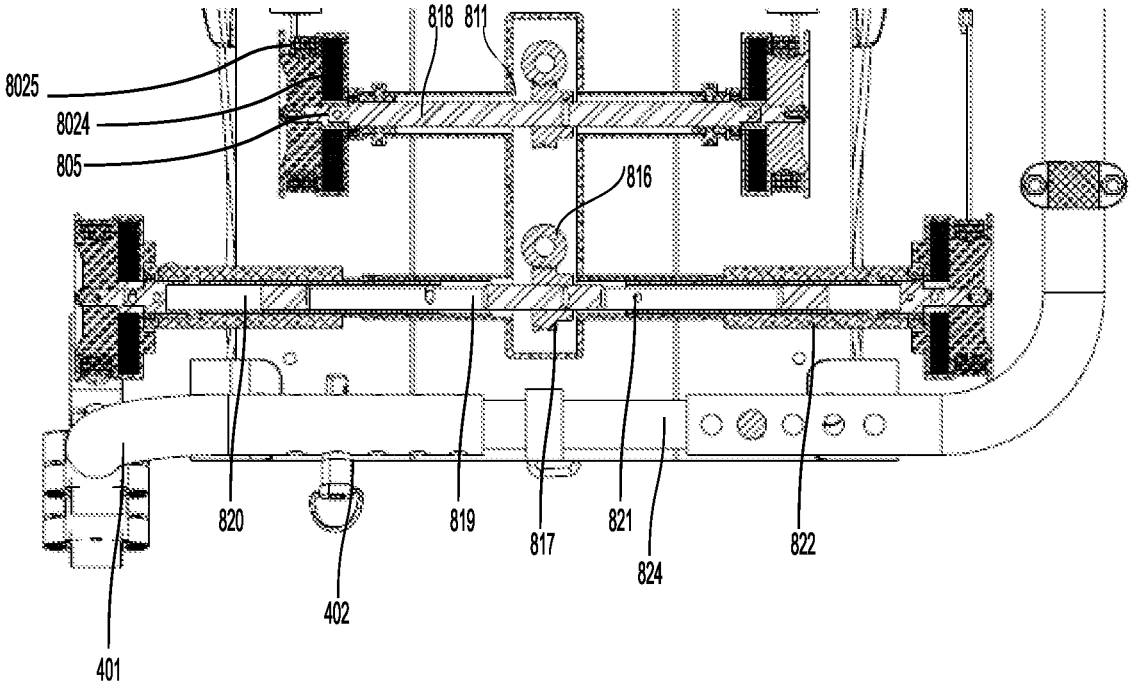
FIG. 13 illustrates a system embodying features consistent with the principles of the present disclosure being used within an environment.
Figure 14:
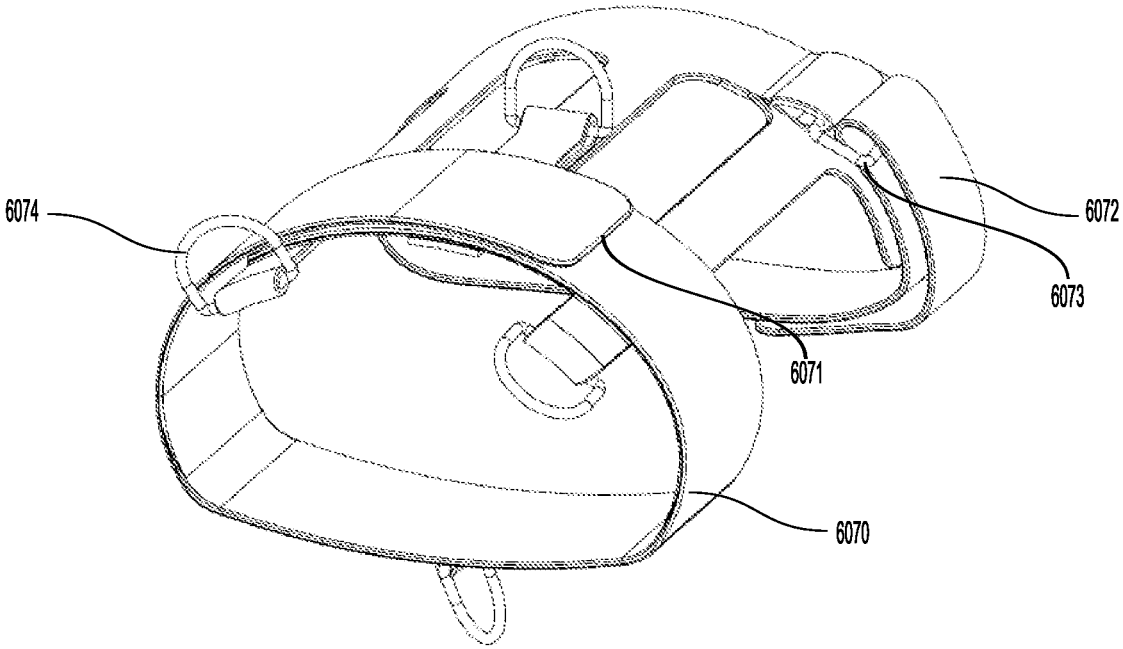
FIG. 14 illustrates a system embodying features consistent with the principles of the present disclosure being used within an environment.

FIGS. 1A-14 illustrate embodiments of a mobile exercise device 100 configured to enhance virtual reality experiences. FIGS. 1A and 1B illustrate a front, left perspective view of a mobile exercise device 100 being used by a user. FIG. 2 illustrates a front, left perspective view of a mobile exercise device 100 comprising a harness, top supports 202, and bottom-carrying arms 40. FIGS. 3A and 3B illustrate a front, left perspective view of a mobile exercise device 100 further comprising a top-carrying arm 70 and mechanical arm 50, 60, wherein said top-carrying arm 70 and the mechanical arm 50, 60 are operably connected to the top support 202. FIG. 4 illustrates a side view of a mobile exercise device 100 comprising a a top-carrying arm 70 and an bottom tube 403 secured to said bottom carrying arm 40. FIG. 5 illustrates a back perspective view of a mobile exercise device 100. FIGS. 6A, 6B, and 8 illustrate perspective views of mechanical arms 50, 60. FIG. 7 illustrates a perspective view of a top-carrying arm 70 with no mechanical arm 50, 60 mounted thereto. FIG. 9 illustrates a back view of the mobile exercise device 100. FIGS. 10A-10C illustrate front views and top views of a mobile exercise device 100 being used by a user, wherein the top-carrying arms 70 and mechanical arms 50, 60 are set at various angles by said user. FIG. 11 illustrates a side view of a mobile exercise device 100 comprising a top-carrying arm 70 and a resistance element 606 secured to a securing element 607. FIGS. 12 and 13 illustrate exploded/cross sectional views of a resistance element 606 in the form of a gear and pulley system having a spring force adjustment mechanism. FIG. 14 illustrates a securing element 607 in the form of a glove.

As illustrated in FIG. 2, the mobile exercise device 100 generally comprises a harness, top supports 202, bottom-carrying arms 40, resistance elements 606, and attachment elements 10 secured to said resistance elements 606, wherein said resistance elements 606 are configured to secure to a securing element worn by a user. The plastic bushing 201 mounted in the top support 202 is used either for hole protection when nothing is mounted or anti-friction part when the rotary mechanical arm 50 is mounted. In one preferred embodiment, a backrest cover is configured to removably attach to the backrest. In the preferred embodiment illustrated in FIGS. 1A and 1B, the attachment elements 10 of the harness comprise two buckles 101 for belt harness adjustment, hip belt 30 with rectangular ring 301, and hook loop scratch 302 for adjustment and tightening.

The resistance elements 606 are preferably guided by said bottom-carrying arms 40 and top supports 202. In some preferred embodiments, the bottom-carrying arms 40 are repositionable to allow for customization of the positioning of the resistance elements 606. Additionally, the resistance elements 606 are preferably configured in a way that allows for a user to adjust the amount of resistance applied by said resistance elements 606. In some embodiments, top-carrying arms 70 may be secured to the top supports 202 of the mobile exercise device 100 in a way that allows for the resistance elements 606 to be oriented at different positions about a user's body. In other embodiments, a mechanical arm 50, 60 may be secured to one of the top supports 202 or top-carrying arms 70 to allow for even more flexible positioning of the resistance elements 606 about a user's body.

The harness comprises a textile component, backrest, and a plurality of straps and is configured to be worn by a user as well as support the top support 202, bottom-carrying arm 40, and resistance elements 606. The textile component preferably comprises a vest or other shape suitable to be worn by a person. In a preferred embodiment, the textile component is configured to cover a user's upper body; however, the textile component may also be configured to cover a user's lower body without departing from the inventive subject matter described herein. The material used to create the textile component is preferably supportive so that it may support the weight of the bottom-carrying arm 40, top supports 202, top-carrying arms 70, and resistance elements 606. For instance, the textile component may comprise a woven polyester/nylon fabric that possesses minimal elastic properties. In another preferred embodiment, the material used to create the textile component is made of a natural fiber material that is machine washable. For instance, the textile component may comprise a hemp/cotton blend that can be placed in a washing machine. As such, the textile component may be permanently attached to the harness or removably attached to the harness without departing from the inventive subject matter described herein.

The plurality of straps may comprise at least one fastening element, which enable a user to secure the textile component to their person. In a preferred embodiment, the plurality of straps may be used by a user to secure said textile component about the user's waist and shoulders in order to fasten said textile component to the user's person. Devices that may act as the fastening element include, but are not limited to, rings, buckles, clasps, or any combination thereof. These fastening elements may be used to adjust how tight the harness is secured to one's person. In particular, the fastening elements may be used to allow a user to adjust how tight the harness is secured about one's waist, chest, and shoulders. Materials that may be used to construct the fastening elements include, but are not limited to, aluminum, metal alloys, carbon fiber, polymer, or any combination thereof.

The backrest assembly preferably comprises a backplate 203 and padding 204, wherein the top support 202 and bottom-carrying arm 40 are attached to said backplate 203. The backplate 203 is preferably stiff so that it may support the various components of the system. Materials that may be used to construct the backplate 203 include, but are not limited to, aluminum, alloys, carbon fiber, polymer, or any combination thereof. The padding 204 is secured to the backplate 203 in way such that it provides a barrier between the back of a user and the backplate 203. In some preferred embodiments, the padding 204 is removeable from the backplate 203, allowing for different padding 204 to be secured to the backplate 203 or to allow for the padding 204 to be washed. In one preferred embodiment, the backrest assembly may further comprise a resistance element adjustment mechanism 80. The resistance elements 606 may be secured to the backrest in a way such that resistance of the resistance elements 606 may be adjusted via the resistance element adjustment mechanism 80.

In one preferred embodiment, the harness may comprise a plurality of fixing elements 12, wherein a first fixing element 12 is attached to a left shoulder region of said harness, a second fixing element 12 is attached to a right shoulder region of said harness, a third fixing element 12 is attached to a left hip region of said harness, and a fourth fixing element 12 is attached to a right hip region of said harness. A first end of a resistance elements 606 may be secured to said plurality of fixing elements 12 and a second end of said resistance element 606 may comprise attachment elements 10 that allow a user to secure the resistance elements 606 to their person via a securing element or to a controller 1813. Devices that may act as fixing elements 12 include, but are not limited to, stitched fabric, carabiners, rings, magnets, buckles, clasps, fasteners, hook-and-loop fasteners, or any combination thereof. Fixing elements 12 may be secured to the harness via stitching, carabiners, rings, magnets, buckles, clasps, fasteners, hook-and-loop fasteners (Velcro), or any combination thereof.

In another preferred embodiment, the harness may comprise a first fixing elements 12 secured to said left shoulder region and a second fixing element 12 secured to said right shoulder region of the harness. Attachment elements 10 attached to a first end of the resistance elements 606 may be secured to each fixing element 12 in order to secure any resistance elements 606 to said harness. Attachment elements 10 of the second end of said resistance elements 606 may then be secured to a securing element and/or a controller 1813. In a preferred embodiment, the harness may comprise between two and ten fixing elements 12. Devices that may act as an attachment element 10 include, but are not limited to, stitched fabric, carabiners, rings, magnets, buckles, clasps, fasteners, hook-and-loop fasteners, or any combination thereof. Fixing elements 12 secured to a harness may be detachable from, and reattachable to, the harness. As such, the total number of fixing elements 12 attached to the harness may be increased or decreased depending upon the nature of the physical activity that the user may be engaging in. Additionally, fixing elements 12 may be secured at points other than the shoulder and hip regions of the vest without departing from the inventive subject matter described herein. For instance, some embodiments of a harness may allow for the attachment of fixing elements 12 to the chest regions, side region, upper/middle/lower back region, etc, which may allow a user to change the location of said fixing elements 12 based on the activity being performed and their comfort level.

The top supports 202 and bottom-carrying arms 40 of the system are preferably secured to the back of the textile component via the backrest. The bottom-carrying arm 40 is preferably laterally adjustable in way that allows a user to adjust the angle in which resistance is applied by resistance elements 606 supported by said bottom-carrying arm 40. The top supports 202 are preferably configured to support top-carrying arms 70 and/or mechanical arms 50, 60, which may also be used to adjust the angle in which resistance is applied to a user using the system. Top-carrying arms 70 and mechanical arms 50, 60 may be removably secured to the top supports 202 and are preferably configured to extend from portions of the harness. In a preferred embodiment, the top-carrying arms 70 and mechanical arms 50, 60 extend from the portion of the harness that, when worn by a user, may be located approximately at the shoulder region and/or hip region. As illustrated in FIG. 13, the bottom carrying arm 40 may be laterally adjusted by sliding it inside the axle 824 and secured in the new position with the fixation pin 402 through the bent tube 401 side holes. The bottom-carrying arms 40 may be laterally adjustable via a stopping pin 402. In a preferred embodiment, the bottom-carrying arm 40 may be swiveled by 110 degrees. As illustrated in FIG. 4, a bottom tube 403 inserted in the bottom carrying arm 40 allows for the attachment of additional resistance elements 606. The bottom tube 403 is also adjustable through the fixation pin 404 and may also comprise a wheel guide 702. As illustrated in FIG. 7, the top-carrying arm 70 may comprise two or more wheel guides 702, wherein the wheel guides 702 are configured to allow for smooth backward or forward movement of the wire 8021 of the spring and pulley system. A clamping knob 601 may be used to adjust the height or angle orientation of any bottom-carrying arm 40 and top-carrying arm 70 secured to the harness.

As illustrated in FIGS. 6A, 6B, and 8, The mechanical arm 50, 60 is configured to rotate on the top support 202 so that a user may change the position of said mechanical arm 50, 60. In a preferred embodiment, the mechanical arm 50, 60 further comprises a clamping knob 601, which a user may use to unlock the mechanical arm 50, 60 so that it be swiveled about the top support 202. In other preferred embodiments, the clamping knob 601 may be used to adjust the height of the mechanical arm 50, 60 above shoulder. The indexing finger 602 allows the front tube 603 to change its angle. The bent tube 608 of the mechanical arm 50, 60 supports it while secured to the top support 202 or top-carrying arm 70. A stop pin 604 allows the front tube 603 to change orientation. In some embodiments, attachment elements 10 of the mechanical arm 50, 60 allow for resistance elements 606, such as resistance bands, to be secured thereto. The mechanical arms 50, 60 may be more than five feet in length and possess the ability to swivel up to 270° on the top support 202 to attain different positions. In some preferred embodiments, the mechanical arms 50, 60 may be contoured so that they comprise a partial enclosure. Alternatively, said mechanical arms 50, 60 may comprise a cylinder having a diameter of two or more inches. In some preferred embodiments, mechanical arms 50, 60 may be removably secured to the bottom-carrying arms 40 and may be configured to rotate downward so that the distal tip of the mechanical arm 50, 60 is directly adjacent to the user's knee. FIG. 6B illustrates the mechanism that adjusts the angle of the mechanical arm through two metallic plates. A first plate 609 is fixed and perforated whereas a second plate 610 is mobile and configured to support the indexing finger 602. The plates are configured to turn against each other through the axle 611, and the whole mechanism is covered by a plastic cover 612.

In some preferred embodiments, as illustrated in FIGS. 3A and 3B, the mechanical arm 50, 60 may be locked into a position while being used by a user 105 or be adjustable by said user 105. As such, the mechanical arm may be a rotary mechanical arm 60 or an adjustable mechanical arm 50, wherein the rotary mechanical arm 60 is configured to be set into a specific position by a user 105 and the adjustable mechanical arm 50 is configured to move based on user 105 movement. A user wearing the harness may aim the rotary mechanical arm 50, 60 with one hand and pull the resistant band with the other to get the experience of a bow and arrow. At least one sensor of the mechanical arm 50, 60 may be operably connected to a virtual reality (VR) headset in way such that the mechanical arm 50, 60 may be tracked as an input device for the system. In yet another preferred embodiment, a first arm of a user may be secured to a mechanical arm 50, 60, allowing a user to grip a resistance element 606 of said mechanical arm 50, 60. The user may then be free to utilize his or her free arm (that which is unattached to the mechanical arm 50, 60) to pull the resistance band in a way that mimics a bow and arrow. FIG. 8 illustrates a preferred embodiment of the rotary mechanical arm 50, which may comprise a bent tube 501, an articulation unit 502, articulating tube 503, sliding snap hook 505, and securing element 607. In some preferred embodiments, the articulating tube 503 may be flexible.

The attachment element 10 of the resistance elements 606 may allow for the attachment of gaming controller 1813 and/or securing elements 607 designed to be secured to the limbs a user's body. When secured in this way, the gaming controllers 1813 and/or securing elements 607 may act as the gripping mechanism necessary for the user to manipulate the resistance elements 606. Devices that may act as the resistance elements 606 of the system may include, but are not limited to, resistance bands, flexible rods, magnets, spring/pulley, or any combination thereof. In some preferred embodiments, the resistance elements 606 may be secured to the ends of the mechanical arm 50, 60, top-carrying arm 70, and or bottom-carrying arm 40 distal from the harness. The resistance elements 606 are preferably used by a user as a means to provide additional resistance training to the muscle groups of the upper body, including, but not limited to, biceps, triceps, brachioradialis, flexor/extensor carpi, deltoids, trapezius, rhomboid minor/major, latissimus dorsi, or any combination thereof. In a preferred embodiment, training in this manner may be conducted by the user holding at least one gaming controller 1813 that is secured to said resistance elements 606 and subsequently engaging in a VR application requiring movement from the user. Alternatively, the user may wear securing elements 607 that are secured to said resistance elements 606 and subsequently engaging in said VR application.

In the preferred embodiment, as illustrated in FIGS. 1A-13, the resistance elements 606 of the device comprise a spring and pulley system having right wire spool assembly 801 and left wire spool assembly 802, wherein a resistance element adjustment mechanism 80 of said spring and pulley system is secured to said backrest, as illustrated in FIGS. 1A-13. Wires 8021 of the spring and pulley system may extend to fixing elements 12, top supports 202, top-carrying arms 70, bottom-carrying arms 40, and/or mechanical arms 50, 60 to a gaming controller 1813 and/or securing elements 607 in order to maximize the range of motion. In some preferred embodiments, the spring and pulley system may be incorporated into the mechanical arm 50, 60 to facilitate movement of the resistance band as actuated by the subject wearing the harness to which the mechanical arms 50, 60 are connected. In a preferred embodiment, the backrest 20 may comprise stiff backplate 203, padding 204, resistance element adjustment mechanism 80, and top-support arms 50. As illustrated in FIGS. 1A-13, the top-carrying arm 70 and bottom-carrying arm 40 may comprise two or more wheel guides 702, wherein the wheel guides 702 are configured to allow for smooth backward or forward movement of the wire 8021 of the spring and pulley system. A clamping knob 601 may be used to adjust the height or angle orientation of any bottom-carrying arm 40 and top-carrying arm 70 secured to the harness.

FIGS. 12 and 13 illustrate the preferred embodiment of the resistance element adjustment mechanism 80 that allows a user to control a spring force of the spring and pulley system. The wire spool assemblies 801, 802 are fixed on a hook shaft 805 via the pulley 8023, screw 8022A, and security washer 8022B. The hook shaft 805 may rotate on the ball bearing 806, which is mounted on the ball bearing support 807. The ball bearing support 807 is mounted on the tube 809 through the screw. To adjust the spring force, a user may turn the main axle 818 through the worm gear 816 and the gear 817, which is mounted on an axle 813 driven by a knob 814. In a preferred embodiment, the main axle 818, worm gear 816, and gear 817 are embedded within the box 811. A door 812 supports the worm gear 816 and ball bearing 815 that are inserted inside the box 811 and fixed through the screw 810. The path of the wire 8021 which comes from the wire spool assemblies 801, 802 preferably moves through plastic bushing outlet 803 and wheel guides 702 to the securing element 607.

FIG. 13 illustrates the lateral position adjustment mechanism of the left/right wire spool assembly 801, 802. This lateral position adjustment preferably comprises a main axle 819 removably secured to a hollow axle 820 and via a pin 821 and is configured to transfer rotation coming from the gear 817 and the worm gear 816 to the hook shaft 805, which in turn causes the rotation to be transferred to the complete assembly. In a preferred embodiment, the lateral position adjustment mechanism turns inside a hollow tube 822. A user may fix the wire spool assemblies 801, 802 via a knob screw 823. When the flat spiral spring 8024 gets turned clockwise by the hook shaft, increased tension is placed on the pulley 8025 and wire. A spring pulley is fixed on a hook shaft 805 through the screw 804 and security washer 8022B. To adjust the spring force, a user may turn the main axle 818 through the worm gear 816 and the gear 817 embedded within the box 811. A door 812 supports the worm gear 816 and ball bearing 806 that are inserted inside the box 811 and fixed through the screw. The path of the wire 8021 which comes from the wire spool assembly 801, 802 preferably moves through plastic bushing outlet 803 and wheel guides 702 to the securing element 607.

In another preferred embodiment, the resistance elements 606 are resistance bands, which may be of varying length and thickness. In a preferred embodiment, the resistance bands are between approximately four inches and approximately five feet in length (when maximally extended). However, one with skill in the art understands that the resistance bands may be of other lengths without departing from the inventive subject matter described herein. Materials that may be used to make the resistance bands include, but are not limited to, rubber, latex, or any combination thereof. In some preferred embodiments, the resistance elements 606 may be secured to the ends of the mechanical arms 50, 60 that are distal to the harness. In some preferred embodiments, the mechanical arms 50, 60 may comprise a resistance element 606 within a cavity of said mechanical arms 50, 60. Said resistance element 606 may extend the length of the mechanical arm 50, 60, wherein hooks or other attachment means may be used to secure the resistance elements 606 thereto. The cavity of the mechanical arm 50, 60 may be a partial enclosure or a complete enclosure. In a preferred embodiment, the diameter of the cavity of the mechanical arms 50, 60 is between 0.5 inches and 10 inches.

In embodiments comprising securing elements 607, the securing elements 607 may comprise two straps for securing said securing elements 607 on user's arms and/or hands. In a preferred embodiment, as illustrated in FIGS. 14, the securing elements 607 are gloves are configured to be secured at a first position about a user's wrist and at a second position about a user's hand. Free space for the fingers and palm allows for easy use of an input device, such as a gaming controller 1813. In a preferred embodiment, a user may tighten the gloves about their wrist via a first strap 6070 and second strap 6072. Hook and loop fasteners 6071 and/or a rectangular rings 6073 may be used to tighten the straps. The straps preferably comprise an attachment element 10, such as buckles, for securing the securing elements 607 to the user's person. At least one ring 6074 extending outward from the securing elements 607 may be used to secure the resistance elements 606 to the user. In an alternative embodiment, securing elements 607 of the present disclosure may comprise a buckle having male and female sections configured to removably secure to one another. In some preferred embodiments of securing elements 607 comprising buckles, resistance elements 606 may be configured in way to removably secure to said male or female section of said buckle of said securing elements 607 via a male or female section of a buckle of said resistance element 606. In yet another preferred embodiment, the securing elements 607 may comprise one or more rings 6074 attached to, and protruding outwardly from, the securing elements 607. An attachment element 10 of the resistance elements 606 may be used to secure said resistance elements 606 to said one or more rings 6074 of said securing elements 607. In other embodiments, a gaming controller 1813 and/or a mechanical arm 50, 60 may be secured to the one or more rings 6074 of the securing elements 607. The securing elements 607 are preferably constructed of materials that facilitate the distribution of pressure over an area. In embodiments where the securing elements 607 are gloves, the securing elements 607 may also comprise a high friction surface that will assist a user to grip objects while wearing said gloves.

According to the embodiments described herein, a subject wearing the harness component may utilize resistance bands as a means by which to exercise various muscle groups of the upper body. For instance, exercise may be conducted by a user of the system by holding with their left hand a gaming controller 1813 located at the distal end of two resistance elements 606 (i.e., distal from the harness) and holding with their right hand a gaming controller 1813 located at the distal end of two other resistance elements 606, wherein said resistance elements 606 of each gaming controller 1813 extend from a shoulder region and hip region of said harness. Because the proximal ends of the resistance elements 606 comprise an attachment element 10 that is secured to a fixing element 12 of the harness worn by the user, the user may exert force in multiple direction away from their body with one or both arms. The user may adjust the location of the fixing elements 12 and/or attachment elements 10 on the harness to target specific muscle groups. Alternatively, in embodiments comprising the various arms of the invention, the user may target specific muscle groups by adjusting the angle relative of the bottom-carrying arm 40, top-carrying arm 70, and mechanical arms 50, 60 to the subject's body at which the subject is pushing forward.

Figure 15:
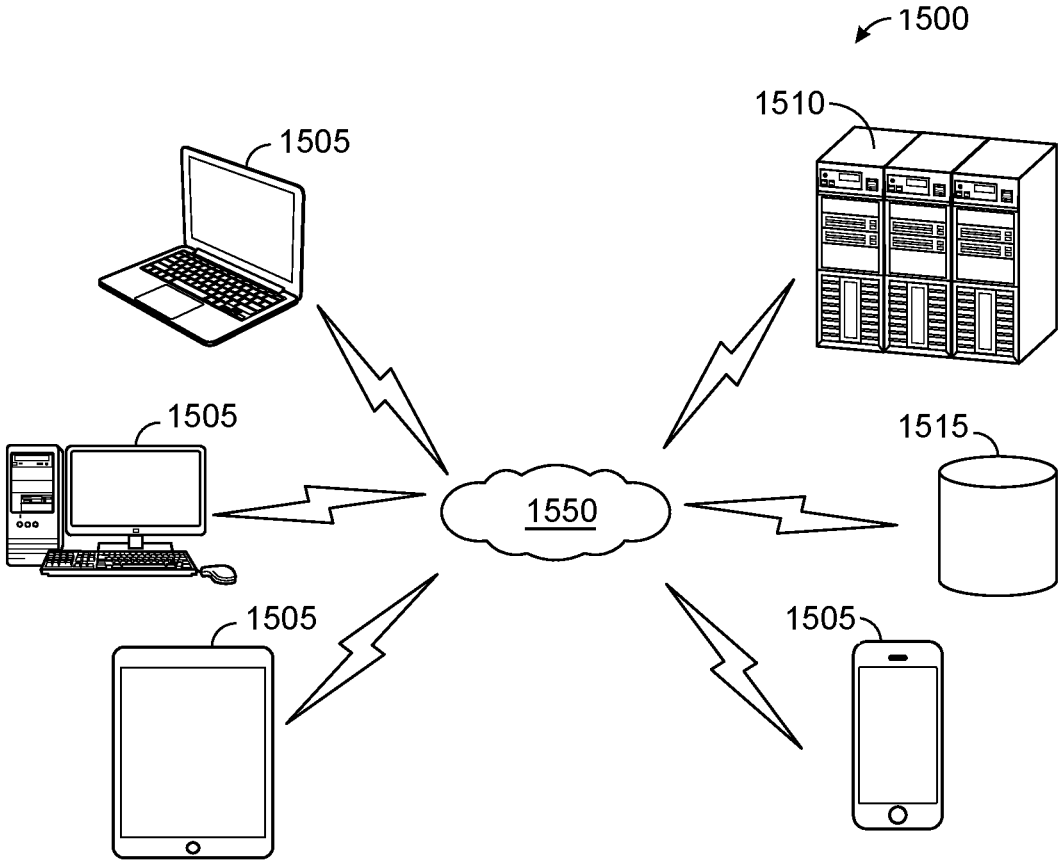
FIG. 15 illustrates a system embodying features consistent with the principles of the present disclosure being used within an environment.

FIGS. 15-22 illustrate the system 100 and methods of use of using a mobile exercise device 100 with a gaming system 1810, wherein said mobile exercise device 100 further comprising computing elements that may be used to automate said mobile exercise device 100. FIG. 15 depicts an exemplary environment 1500 of the system 1800 consisting of clients 1505 connected to a server 1510 and/or database 1515 via a network 1550. Clients 1505 are devices of users 105 that may be used to access servers 1510 and/or databases 1515 through a network 1550. A network 1550 may comprise of one or more networks of any kind, including, but not limited to, a local area network (LAN), a wide area network (WAN), metropolitan area networks (MAN), a telephone network, such as the Public Switched Telephone Network (PSTN), an intranet, the Internet, a memory device, another type of network, or a combination of networks. In a preferred embodiment, computing entities 1600 may act as clients 1505 for a user 105. For instance, a client 1505 may include a personal computer, a wireless telephone, a streaming device, a "smart" television, a personal digital assistant (PDA), a laptop, a smart phone, a tablet computer, or another type of computation or communication interface 1680. Servers 1510 may include devices that access, fetch, aggregate, process, search, provide, and/or maintain documents. Although FIG. 15 depicts a preferred embodiment of an environment 1500 for the system 1800, in other implementations, the environment 1500 may contain fewer components, different components, differently arranged components, and/or additional components than those depicted in FIG. 15. Alternatively, or additionally, one or more components of the environment 1500 may perform one or more other tasks described as being performed by one or more other components of the environment 1500.

As depicted in FIG. 15, one embodiment of the system 1800 may comprise a server 1510. Although shown as a single server 1510 in FIG. 15, a server 1510 may, in some implementations, be implemented as multiple devices interlinked together via the network 1550, wherein the devices may be distributed over a large geographic area and performing different functions or similar functions. For instance, two or more servers 1510 may be implemented to work as a single server 1510 performing the same tasks. Alternatively, one server 1510 may perform the functions of multiple servers 1510. For instance, a single server 1510 may perform the tasks of a web server and an indexing server 1510. Additionally, it is understood that multiple servers 1510 may be used to operably connect the processor 1620 to the database 1515 and/or other content repositories. The processor 1620 may be operably connected to the server 1510 via wired or wireless connection. Types of servers 1510 that may be used by the system 1800 include, but are not limited to, search servers, document indexing servers, and web servers, or any combination thereof.

Search servers may include one or more computing entities 1600 designed to implement a search engine, such as a documents/records search engine, general webpage search engine, etc. Search servers may, for example, include one or more web servers designed to receive search queries and/or inputs from users 105, search one or more databases 1515 in response to the search queries and/or inputs, and provide documents or information, relevant to the search queries and/or inputs, to users 105. In some implementations, search servers may include a web search server that may provide webpages to users 105, wherein a provided webpage may include a reference to a web server at which the desired information and/or links are located. The references to the web server at which the desired information is located may be included in a frame and/or text box, or as a link to the desired information/document. Document indexing servers may include one or more devices designed to index documents available through networks 150. Document indexing servers may access other servers 1510, such as web servers that host content, to index the content. In some implementations, document indexing servers may index documents/records stored by other servers 1510 connected to the network 1550. Document indexing servers may, for example, store and index content, information, and documents relating to user accounts and user-generated content. Web servers may include servers 1510 that provide webpages to clients 1505. For instance, the webpages may be HTML-based webpages. A web server may host one or more websites. As used herein, a website may refer to a collection of related webpages. Frequently, a website may be associated with a single domain name, although some websites may potentially encompass more than one domain name. The concepts described herein may be applied on a per-website basis. Alternatively, in some implementations, the concepts described herein may be applied on a per-webpage basis.

As used herein, a database 1515 refers to a set of related data and the way it is organized. Access to this data is usually provided by a database management system (DBMS) consisting of an integrated set of computer software that allows users 105 to interact with one or more databases 1515 and provides access to all of the data contained in the database 1515. The DBMS provides various functions that allow entry, storage and retrieval of large quantities of information and provides ways to manage how that information is organized. Because of the close relationship between the database 1515 and the DBMS, as used herein, the term database 1515 refers to both a database 1515 and DBMS.

Figure 16:
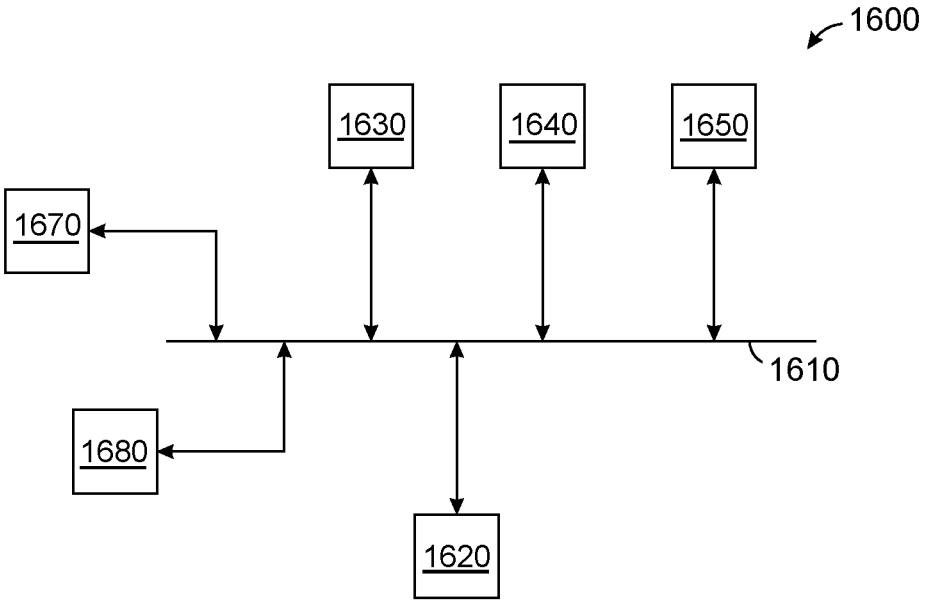
FIG. 16 illustrates a system embodying features consistent with the principles of the present disclosure being used within an environment.

FIG. 16 is an exemplary diagram of a client 1505, server 1510, and/or or database 1515 (hereinafter collectively referred to as "computing entity 1600"), which may correspond to one or more of the clients 1505, servers 1510, and databases 1515 according to an implementation consistent with the principles of the invention as described herein. The computing entity 1600 may comprise a bus 1610, a processor 1620, memory 1704, a storage device 1650, a peripheral device 1670, and a communication interface 1680 (such as wired or wireless communication device). The bus 1610 may be defined as one or more conductors that permit communication among the components of the computing entity 1600. The processor 1620 may be defined as logic circuitry that responds to and processes the basic instructions that drive the computing entity 1600. Memory 1704 may be defined as the integrated circuitry that stores information for immediate use in a computing entity 1600. A peripheral device 1670 may be defined as any hardware used by a user 105 and/or the computing entity 1600 to facilitate communicate between the two. A storage device 1650 may be defined as a device used to provide mass storage to a computing entity 1600. A communication interface 1680 may be defined as any transceiver-like device that enables the computing entity 1600 to communicate with other devices and/or computing entities 1600.

The bus 1610 may comprise a high-speed interface 1708 and/or a low-speed interface 1712 that connects the various components together in a way such they may communicate with one another. A high-speed interface 1708 manages bandwidth-intensive operations for computing device 1700, while a low-speed interface 1712 manages lower bandwidth-intensive operations. In some preferred embodiments, the high-speed interface 1708 of a bus 1610 may be coupled to the memory 1704, display 1716, and to high-speed expansion ports 1710, which may accept various expansion cards such as a graphics processing unit (GPU). In other preferred embodiments, the low-speed interface 1712 of a bus 1610 may be coupled to a storage device 1650 and low-speed expansion ports 1714. The low-speed expansion ports 1714 may include various communication ports, such as USB, Bluetooth, Ethernet, wireless Ethernet, etc. Additionally, the low-speed expansion ports 1714 may be coupled to one or more peripheral devices 1670, such as a keyboard, pointing device, scanner, and/or a networking device, wherein the low-speed expansion ports 1714 facilitate the transfer of input data from the peripheral devices 1670 to the processor 1620 via the low-speed interface 1712.

The processor 1620 may comprise any type of conventional processor or microprocessor that interprets and executes computer readable instructions. The processor 1620 is configured to perform the operations disclosed herein based on instructions stored within the system 1800. The processor 1620 may process instructions for execution within the computing entity 1600, including instructions stored in memory 1704 or on a storage device 1650, to display graphical information for a graphical user interface (GUI) on an external peripheral device 1670, such as a display 1716. The processor 1620 may provide for coordination of the other components of a computing entity 1600, such as control of user interfaces 1511, applications run by a computing entity 1600, and wireless communication by a communication interface 1680 of the computing entity 1600. The processor 1620 may be any processor or microprocessor suitable for executing instructions. In some embodiments, the processor 1620 may have a memory device therein or coupled thereto suitable for storing the data, content, or other information or material disclosed herein. In some instances, the processor 1620 may be a component of a larger computing entity 1600. A computing entity 1600 that may house the processor 1620 therein may include, but are not limited to, laptops, desktops, workstations, personal digital assistants, servers 1510, mainframes, cellular telephones, tablet computers, smart televisions, streaming devices, or any other similar device. Accordingly, the inventive subject matter disclosed herein, in full or in part, may be implemented or utilized in devices including, but are not limited to, laptops, desktops, workstations, personal digital assistants, servers 1510, mainframes, cellular telephones, tablet computers, smart televisions, streaming devices, or any other similar device.

Memory 1704 stores information within the computing device 1700. In some preferred embodiments, memory 1704 may include one or more volatile memory units. In another preferred embodiment, memory 1704 may include one or more non-volatile memory units. Memory 1704 may also include another form of computer-readable medium, such as a magnetic, solid state, or optical disk. For instance, a portion of a magnetic hard drive may be partitioned as a dynamic scratch space to allow for temporary storage of information that may be used by the processor 1620 when faster types of memory, such as random-access memory (RAM), are in high demand. A computer-readable medium may refer to a non-transitory computer-readable memory device. A memory device may refer to storage space within a single storage device 1650 or spread across multiple storage devices 1650. The memory 1704 may comprise main memory 1630 and/or read only memory (ROM) 1640. In a preferred embodiment, the main memory 1630 may comprise RAM or another type of dynamic storage device 1650 that stores information and instructions for execution by the processor 1620. ROM 1640 may comprise a conventional ROM device or another type of static storage device 1650 that stores static information and instructions for use by processor 1620. The storage device 1650 may comprise a magnetic and/or optical recording medium and its corresponding drive.

As mentioned earlier, a peripheral device 1670 is a device that facilitates communication between a user 105 and the processor 1620. The peripheral device 1670 may include, but is not limited to, an input device and/or an output device. As used herein, an input device may be defined as a device that allows a user 105 to input data and instructions that is then converted into a pattern of electrical signals in binary code that are comprehensible to a computing entity 1600. An input device of the peripheral device 1670 may include one or more conventional devices that permit a user 105 to input information into the computing entity 1600, such as a controller, scanner, phone, camera, scanning device, keyboard, a mouse, a pen, voice recognition and/or biometric mechanisms, etc. As used herein, an output device may be defined as a device that translates the electronic signals received from a computing entity 1600 into a form intelligible to the user 105. An output device of the peripheral device 1670 may include one or more conventional devices that output information to a user 105, including a display 1716, a printer, a speaker, an alarm, a projector, etc. Additionally, storage devices 1650, such as CD-ROM drives, and other computing entities 1600 may act as a peripheral device 1670 that may act independently from the operably connected computing entity 1600. For instance, a streaming device may transfer data to a smartphone, wherein the smartphone may use that data in a manner separate from the streaming device.

The storage device 1650 is capable of providing the computing entity 1600 mass storage. In some embodiments, the storage device 1650 may comprise a computer-readable medium such as the memory 1704, storage device 1650, or memory 1704 on the processor 1620. A computer-readable medium may be defined as one or more physical or logical memory devices and/or carrier waves. Devices that may act as a computer readable medium include, but are not limited to, a hard disk device, optical disk device, tape device, flash memory or other similar solid-state memory device, or an array of devices, including devices in a storage area network or other configurations. Examples of computer-readable mediums include, but are not limited to, magnetic media such as hard disks, floppy disks, and magnetic tape; optical media such as CD ROM discs and DVDs; magneto-optical media such as optical discs; and hardware devices that are specially configured to store and perform programming instructions, such as ROM 1640, RAM, flash memory, and the like.

In an embodiment, a computer program may be tangibly embodied in the storage device 1650. The computer program may contain instructions that, when executed by the processor 1620, performs one or more steps that comprise a method, such as those methods described herein. The instructions within a computer program may be carried to the processor 1620 via the bus 1610. Alternatively, the computer program may be carried to a computer-readable medium, wherein the information may then be accessed from the computer-readable medium by the processor 1620 via the bus 1610 as needed. In a preferred embodiment, the software instructions may be read into memory 1704 from another computer-readable medium, such as data storage device 1650, or from another device via the communication interface 1680. Alternatively, hardwired circuitry may be used in place of or in combination with software instructions to implement processes consistent with the principles as described herein. Thus, implementations consistent with the invention as described herein are not limited to any specific combination of hardware circuitry and software.

Figure 17:
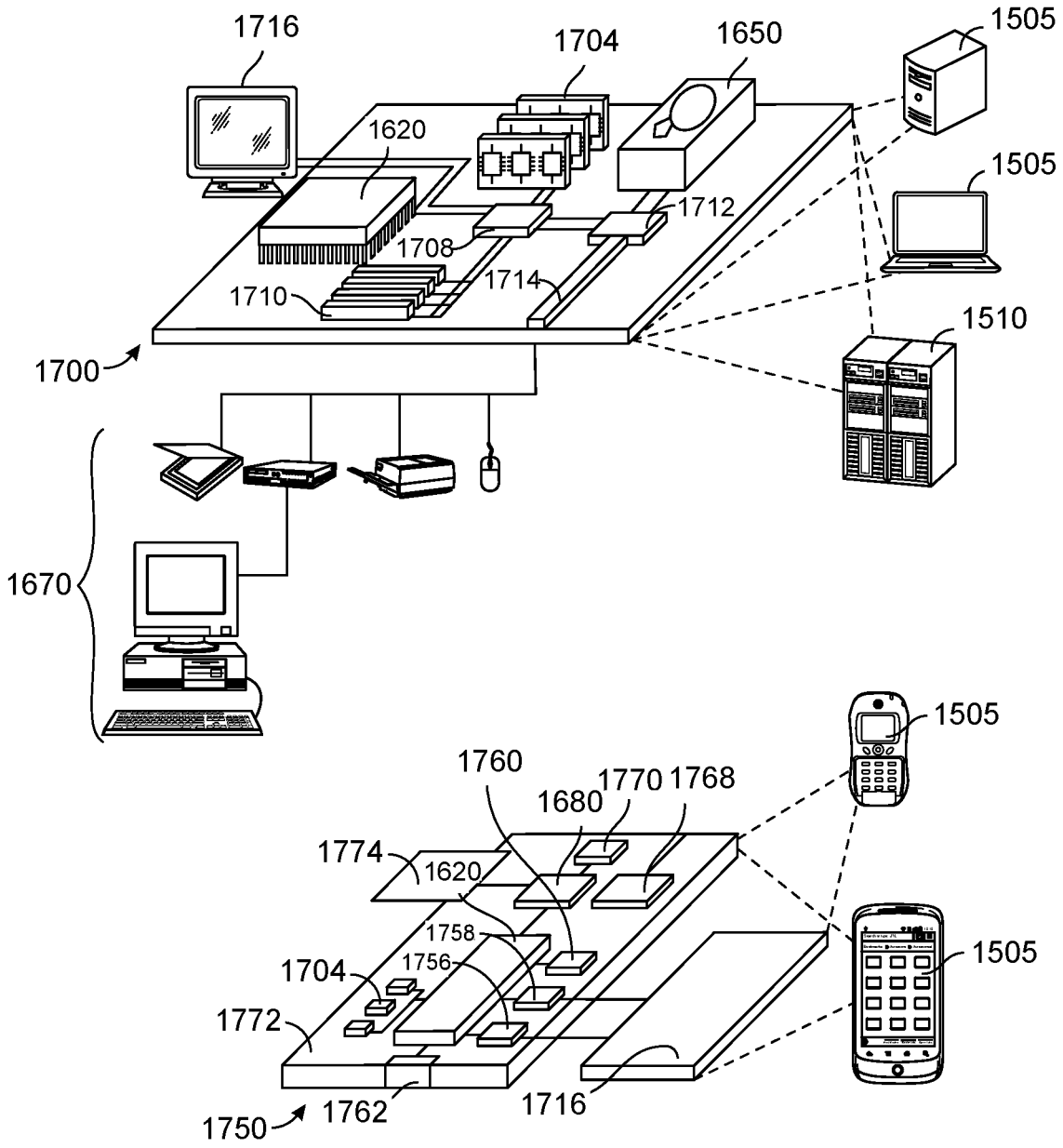
FIG. 17 illustrates a system embodying features consistent with the principles of the present disclosure being used within an environment.

FIG. 17 depicts exemplary computing entities 1600 in the form of a computing device 1700 and mobile computing device 1750, which may be used to carry out the various embodiments of the invention as described herein. A computing device 1700 is intended to represent various forms of digital computers, such as laptops, desktops, workstations, servers 1510, databases 1515, mainframes, and other appropriate computers. A mobile computing device 1750 is intended to represent various forms of mobile devices, such as scanners, scanning devices, personal digital assistants, cellular telephones, smart phones, tablet computers, and other similar devices. The various components depicted in FIG. 17, as well as their connections, relationships, and functions are meant to be examples only, and are not meant to limit the implementations of the invention as described herein. The computing device 1700 may be implemented in a number of different forms, as shown in FIGS. 15 and 17. For instance, a computing device 1700 may be implemented as a server 1510 or in a group of servers 1510. Computing devices 1700 may also be implemented as part of a rack server system. In addition, a computing device 1700 may be implemented as a personal computer, such as a desktop computer or laptop computer. Alternatively, components from a computing device 1700 may be combined with other components in a mobile device, thus creating a mobile computing device 1750. Each mobile computing device 1750 may contain one or more computing devices 1700 and mobile devices, and an entire system may be made up of multiple computing devices 1700 and mobile devices communicating with each other as depicted by the mobile computing device 1750 in FIG. 17. The computing entities 1600 consistent with the principles of the invention as disclosed herein may perform certain receiving, communicating, generating, output providing, correlating, and storing operations as needed to perform the various methods as described in greater detail below.

In the embodiment depicted in FIG. 17, a computing device 1700 may include a processor 1620, memory 1704 a storage device 1650, high-speed expansion ports 1710, low-speed expansion ports 1714, and bus 1610 operably connecting the processor 1620, memory 1704, storage device 1650, high-speed expansion ports 1710, and low-speed expansion ports 1714. In one preferred embodiment, the bus 1610 may comprise a high-speed interface 1708 connecting the processor 1620 to the memory 1704 and high-speed expansion ports 1710 as well as a low-speed interface 1712 connecting to the low-speed expansion ports 1714 and the storage device 1650. Because each of the components are interconnected using the bus 1610, they may be mounted on a common motherboard as depicted in FIG. 17 or in other manners as appropriate. The processor 1620 may process instructions for execution within the computing device 1700, including instructions stored in memory 1704 or on the storage device 1650. Processing these instructions may cause the computing device 1700 to display graphical information for a GUI on an output device, such as a display 1716 coupled to the high-speed interface 1708. In other implementations, multiple processors and/or multiple buses may be used, as appropriate, along with multiple memory units and/or multiple types of memory. Additionally, multiple computing devices may be connected, wherein each device provides portions of the necessary operations.

A mobile computing device 1750 may include a processor 1620, memory 1704 a peripheral device 1670 (such as a display 1716, a communication interface 1680, and a transceiver 1768, among other components). A mobile computing device 1750 may also be provided with a storage device 1650, such as a micro-drive or other previously mentioned storage device 1650, to provide additional storage. Preferably, each of the components of the mobile computing device 1750 are interconnected using a bus 1610, which may allow several of the components of the mobile computing device 1750 to be mounted on a common motherboard as depicted in FIG. 17 or in other manners as appropriate. In some implementations, a computer program may be tangibly embodied in an information carrier. The computer program may contain instructions that, when executed by the processor 1620, perform one or more methods, such as those described herein. The information carrier is preferably a computer-readable medium, such as memory, expansion memory 1774, or memory 1704 on the processor 1620 such as ROM 1640, that may be received via the transceiver or external interface 1762. The mobile computing device 1750 may be implemented in a number of different forms, as shown in FIG. 17. For example, a mobile computing device 1750 may be implemented as a cellular telephone, part of a smart phone, personal digital assistant, or other similar mobile device.

The processor 1620 may execute instructions within the mobile computing device 1750, including instructions stored in the memory 1704 and/or storage device 1650. The processor 1620 may be implemented as a chipset of chips that may include separate and multiple analog and/or digital processors. The processor 1620 may provide for coordination of the other components of the mobile computing device 1750, such as control of the user interfaces 1511, applications run by the mobile computing device 1750, and wireless communication by the mobile computing device 1750. The processor 1620 of the mobile computing device 1750 may communicate with a user 105 through the control interface 1758 coupled to a peripheral device 1670 and the display interface 1756 coupled to a display 1716. The display 1716 of the mobile computing device 1750 may include, but is not limited to, Liquid Crystal Display (LCD), Light Emitting Diode (LED) display, Organic Light Emitting Diode (OLED) display, and Plasma Display Panel (PDP), or any combination thereof. The display interface 1756 may include appropriate circuitry for causing the display 1716 to present graphical and other information to a user 105. The control interface 1758 may receive commands from a user 105 via a peripheral device 1670 and convert the commands into a computer readable signal for the processor 1620. In addition, an external interface 1762 may be provided in communication with processor 1620, which may enable near area communication of the mobile computing device 1750 with other devices. The external interface 1762 may provide for wired communications in some implementations or wireless communication in other implementations. In a preferred embodiment, multiple interfaces may be used in a single mobile computing device 1750 as is depicted in FIG. 17.

Memory 1704 stores information within the mobile computing device 1750. Devices that may act as memory 1704 for the mobile computing device 1750 include, but are not limited to computer-readable media, volatile memory, and non-volatile memory. Expansion memory 1774 may also be provided and connected to the mobile computing device 1750 through an expansion interface 1772, which may include a Single In-Line Memory Module (SIM) card interface or micro secure digital (Micro-SD) card interface. Expansion memory 1774 may include, but is not limited to, various types of flash memory and non-volatile random-access memory (NVRAM). Such expansion memory 1774 may provide extra storage space for the mobile computing device 1750. In addition, expansion memory 1774 may store computer programs or other information that may be used by the mobile computing device 1750. For instance, expansion memory 1774 may have instructions stored thereon that, when carried out by the processor 1620, cause the mobile computing device 1750 perform the methods described herein. Further, expansion memory 1774 may have secure information stored thereon; therefore, expansion memory 1774 may be provided as a security module for a mobile computing device 1750, wherein the security module may be programmed with instructions that permit secure use of a mobile computing device 1750. In addition, expansion memory 1774 having secure applications and secure information stored thereon may allow a user 105 to place identifying information on the expansion memory 1774 via the mobile computing device 1750 in a non-hackable manner.

A mobile computing device 1750 may communicate wirelessly through the communication interface 1680, which may include digital signal processing circuitry where necessary. The communication interface 1680 may provide for communications under various modes or protocols, including, but not limited to, Global System Mobile Communication (GSM), Short Message Services (SMS), Enterprise Messaging System (EMS), Multimedia Messaging Service (MMS), Code Division Multiple Access (CDMA), Time Division Multiple Access (TDMA), Personal Digital Cellular (PDC), Wideband Code Division Multiple Access (WCDMA), IMT Multi-Carrier (CDMAX 0), and General Packet Radio Service (GPRS), or any combination thereof. Such communication may occur, for example, through a transceiver 1768. Short-range communication may occur, such as using a Bluetooth, WIFI, or other such transceiver 1768. In addition, a Global Positioning System (GPS) receiver module 1770 may provide additional navigation- and location-related wireless data to the mobile computing device 1750, which may be used as appropriate by applications running on the mobile computing device 1750. Alternatively, the mobile computing device 1750 may communicate audibly using an audio codec 1760, which may receive spoken information from a user 105 and covert the received spoken information into a digital form that may be processed by the processor 1620. The audio codec 1760 may likewise generate audible sound for a user 105, such as through a speaker, e.g., in a handset of mobile computing device 1750. Such sound may include sound from voice telephone calls, recorded sound such as voice messages, music files, etc. Sound may also include sound generated by applications operating on the mobile computing device 1750.

The system 1800 may also comprise a power supply. The power supply may be any source of power that provides the system 1800 with power. In an embodiment, the power supply may be a stationary power outlet. The system 1800 may comprise of multiple power supplies that may provide power to the system 1800 in different circumstances. For instance, the system 1800 may be directly plugged into a stationary power outlet, which may provide power to the system 1800 so long as it remains in one place. However, the system 1800 may also be connected to a backup battery so that the system 1800 may receive power even when the power supply is not connected to a stationary power outlet or if the stationary power outlet ceases to provide power to the computing entity 1600.

In some preferred embodiments, the system 1800 may further comprise a control board 1805B, actuator 1805A operably connected to said control board 1805B, processor 1620 operably connected to said control board 1805B, and non-transitory computer-readable medium 1816 operably connected to said processor 1620 and containing instructions thereon. The processor 1620 may be operably connected to a virtual reality headset and configured to transmit instructions from said virtual reality headset to said control board 1805B via a communication interface. Based off of the instructions, the control board 1805B may manipulate the actuator 1805A in way such that it manipulates the amount of resistance applied by the resistance elements 606. The instructions sent by the processor 1620 to the control board 1805B are preferably based on actions taken by the user 105 within a VR environment displayed on said VR headset. Further, the system 1800 may be configured to adjust resistance elements 606 so that resistance is applied asymmetrically or symmetrically to the user 105. By relaying instructions to the control board 1805B to cause the actuator 1805A to quickly change resistance, both asymmetrical and symmetrical training may be achieved with this system 1800.

Figure 18:
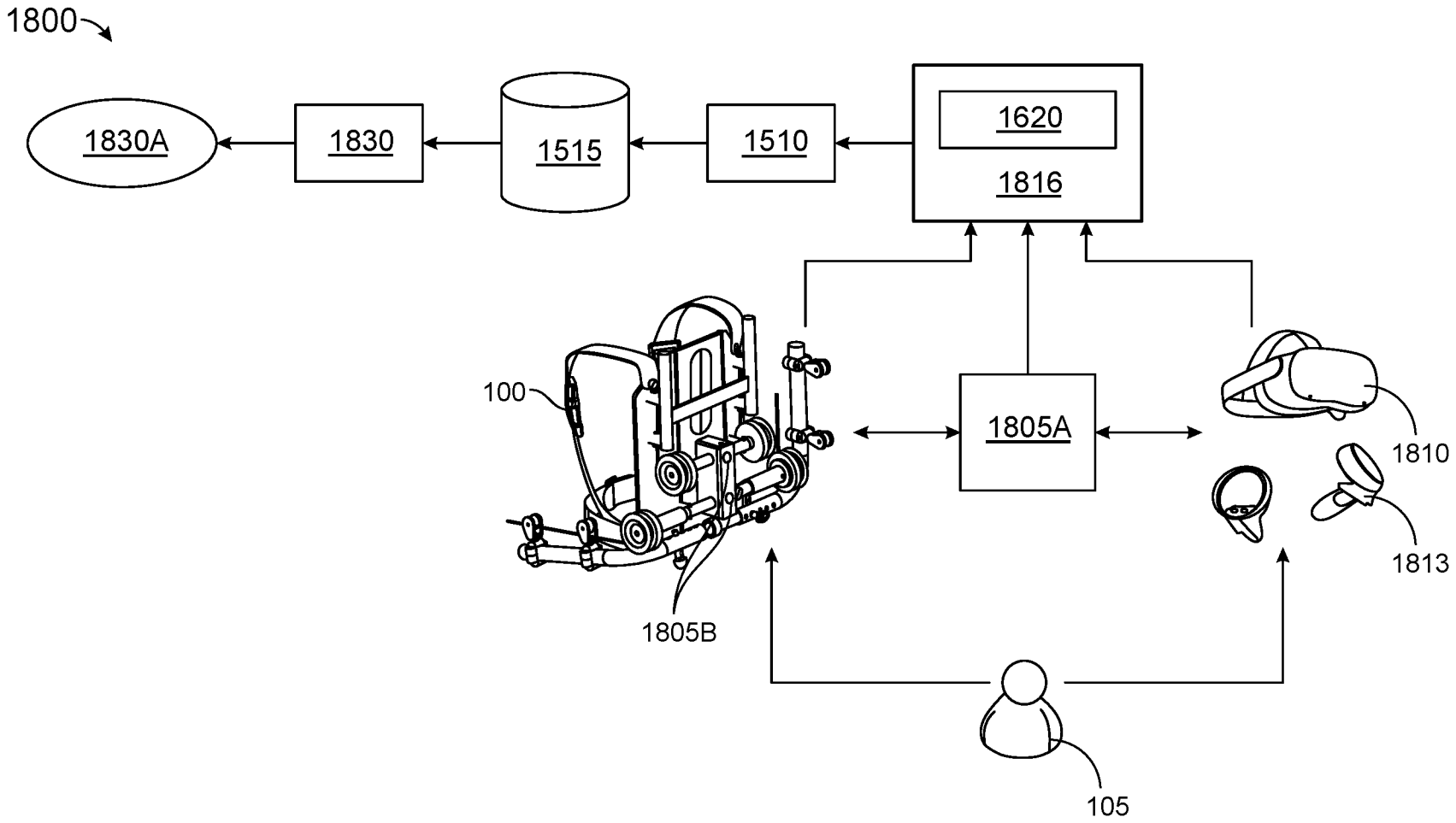
FIG. 18 illustrates a system embodying features consistent with the principles of the present disclosure being used within an environment.

The control board 1805B, as illustrated in FIG. 18 comprises at least one circuit and microchip. In another preferred embodiment, the control board 1805B may further comprise a wireless communication interface 1680, which may allow the control board 1805B to receive instructions from an input device controlled by a user 105. The control board 1805B may facilitate the communication between a VR headset and the actuator 1805A in order to modulate the resistance of the resistance elements 606. The microchip of the control board 1805B comprises a microprocessor 1620 and memory. In another preferred embodiment, the microchip may further comprise a wireless communication interface 1680 in the form of an antenna. The microprocessor 1620 may be defined as a multipurpose, clock driven, register based, digital-integrated circuit which accepts binary data as input, processes it according to instructions stored in its memory, and provides results as output. In a preferred embodiment, the microprocessor 1620 may receive instructions from a gaming system 1810, wherein the gaming system 1810 sends instructions to the control board 1805B that control the actuator 1805A in a way that manipulates the actuator 1805A.

The processor 1620 may convert instructions received from the VR headset into actions to be made by actuator 1805A. In another preferred embodiment, the microprocessor 1620 may convert data of the actuator 1805A into data that may be used by the VR headset to enhance a VR experience. In some preferred embodiments, the VR headset may automatically be configured to send instructions to a paired control board 1805B in order to automatically adjust resistance of the resistance elements 606 via the actuator 1805A. Alternatively, the microprocessor 1620 may receive instructions from an input device via an antenna, which may instruct the microprocessor 1620 as to how to adjust the resistance via the actuator 1805A. For instance, a user 105 may choose "Endurance Mode" on the input device to cause the actuator 1805A to adjust resistance so that a user may perform an exercise multiple times without too much strain on the user's muscles. For instance, a user 105 may select "Strength Mode" within a user interface 1911, which may cause the system 1800 to increase resistance so that a user may perform fewer movements before feeling muscle strain. For instance, the user may use the command word "Automatic" to cause the system 1800 to automatically adjust based on actions performed by a user within a VR environment. Ways in which the input device may communicate with the control board 1805B include, but are not limited, to near field communication (NFC), Bluetooth, infrared (IR), radio-frequency communication (RFC), radio-frequency identification (RFID), and ANT+, or any combination thereof. In one preferred embodiment, the control board 1805B may be connected to the input via a wired connection.

Figure 19:
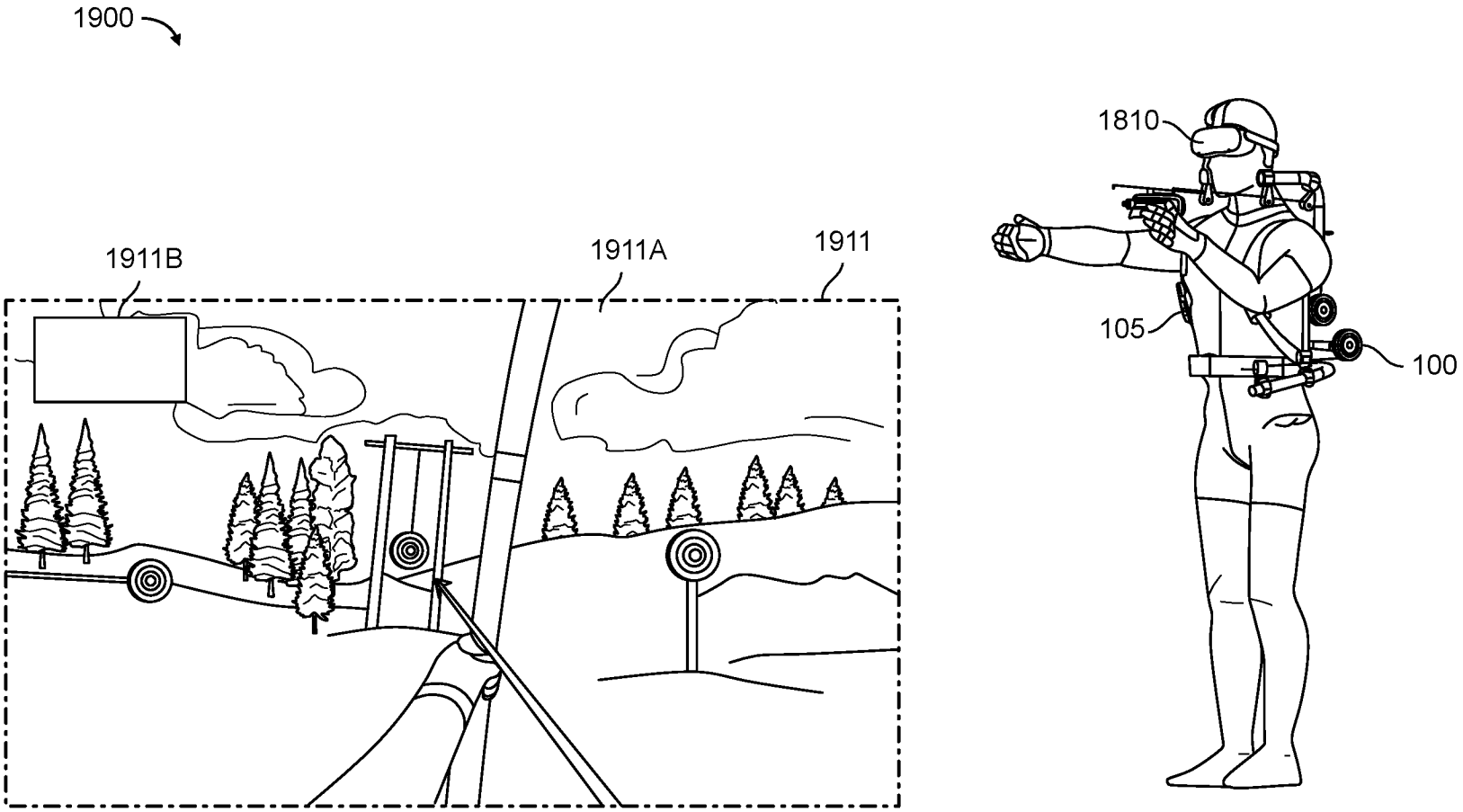
FIG. 19 illustrates a system embodying features consistent with the principles of the present disclosure being used within an environment.

As mentioned previously, the system 1800 may further comprise a user interface 1911, as illustrated in FIG. 19. A user interface 1911 may be defined as a space where interactions between a user 105 and the system 1800 may take place. In an embodiment, the interactions may take place in a way such that a user 105 may control the operations of the system 1800. A user interface 1911 may include, but is not limited to operating systems, command line user interfaces, conversational interfaces, web-based user interfaces, zooming user interfaces, touch screens, task-based user interfaces, touch user interfaces, text-based user interfaces, intelligent user interfaces, and graphical user interfaces, or any combination thereof. The system 1800 may present data of the user interface 1911 to the user 105 via a display 1716 operably connected to the processor 1620. A display 1716 may be defined as an output device that communicates data that may include, but is not limited to, visual, auditory, cutaneous, kinesthetic, olfactory, and gustatory, or any combination thereof. In a preferred embodiment, the display is part of a gaming system 1810, including VR headsets and console gaming systems.

In a preferred embodiment, the display 1716 receives the user interface 1911 from the control board 1805B and presents it to a user 105. In another preferred embodiment, the user interface 1911 may also comprise a command window 1911B, wherein said command window 1911B is nested within a parent window 1911A of the display. The processor 1620 may manipulate the command window 1911B based on commands received from an input device. The input device may be connected to the system via a wired or wireless connection. In a preferred embodiment, the input device communicates commands to the processor 1620, which the processor 1620 uses to manipulate the command window 1911B. Indicia within the command window 1911B may be used to indicate settings a user may select that may cause the system to automatically adjust resistance of the resistance elements 606. In a preferred embodiment, indicia used within the command window 1911B indicate a type of workout a user wants to perform using the system.

Information presented via a display 1716 may be referred to as a soft copy of the information because the information exists electronically and is presented for a temporary period of time. Information stored on the non-transitory computer-readable medium 1816 may be referred to as the hard copy of the information. For instance, a display 1716 may present a soft copy of visual information via a liquid crystal display (LCD), wherein the hardcopy of the visual information is stored on a local hard drive. For instance, a display 1716 may present a soft copy of audio information via a speaker, wherein the hard copy of the audio information is stored in RAM. For instance, a display 1716 may present a soft copy of tactile information via a haptic suit, wherein the hard copy of the tactile information is stored within a database 1515. Displays 1716 may include, but are not limited to, cathode ray tube monitors, LCD monitors, light emitting diode (LED) monitors, gas plasma monitors, screen readers, speech synthesizers, haptic suits, virtual reality headsets, speakers, and scent generating devices, or any combination thereof.

Figure 20:
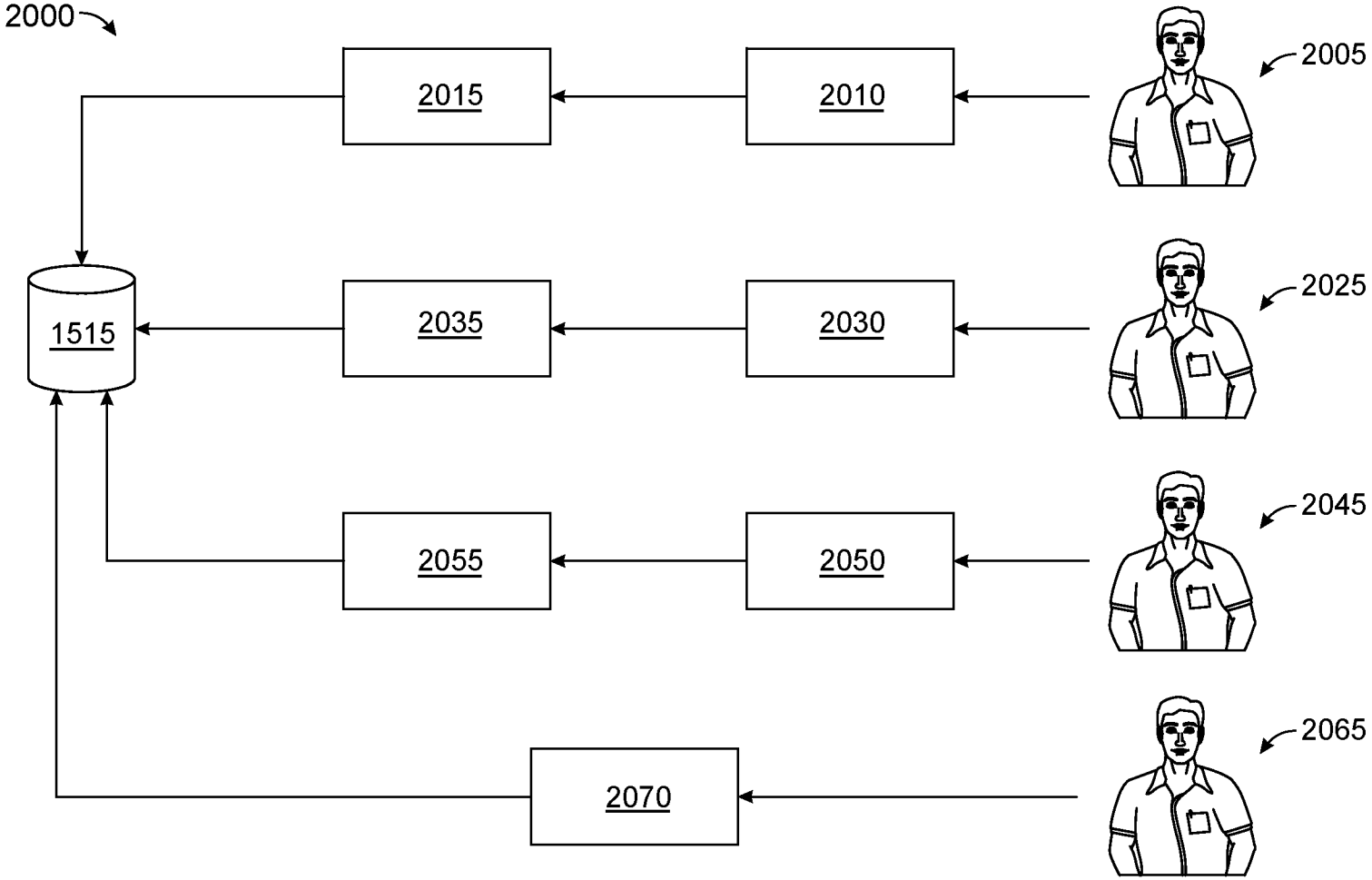
FIG. 20 illustrates the manner in which individual access to data may be granted or limited based on user roles and administrator roles.

To prevent un-authorized users 105 from accessing other user's 105 information, the system 1800 may employ a security method. As illustrated in FIG. 20, the security method of the system 1800 may comprise a plurality of permission levels 2000 that may grant users 105 access to user content 2015, 2035, 2055 within the database 1515 while simultaneously denying users 105 without appropriate permission levels 2000 the ability to view user content 2015, 2035, 2055. To access the user content 2015, 2035, 2055 stored within the database 1515, users 105 may be required to make a request via a user interface 1911. Access to the data within the database 1515 may be granted or denied by the processor 1620 based on verification of a requesting user's 2005, 2025, 2045 permission level 2000. If the requesting user's 2005, 2025, 2045 permission level 2000 is sufficient, the processor 1620 may provide the requesting user 2005, 2025, 2045 access to user content 2015, 2035, 2055 stored within the database 1515. Conversely, if the requesting user's 2005, 2025, 2045 permission level 2000 is insufficient, the processor 1620 may deny the requesting user 2005, 2025, 2045 access to user content 2015, 2035, 2055 stored within the database 1515. In an embodiment, permission levels 2000 may be based on user roles 2010, 2030, 2050 and administrator roles 2070, as illustrated in FIG. 20. User roles 2010, 2030, 2050 allow requesting users 2005, 2025, 2045 to access user content 2015, 2035, 2055 that a user 105 has uploaded and/or otherwise obtained through use of the system 1800. Administrator roles 2070 allow administrators 2065 to access system wide data.

In an embodiment, user roles 2010, 2030, 2050 may be assigned to a user in a way such that a requesting user 2005, 2025, 2045 may view user profiles 1425 containing user data 1425A via a user interface 1911. To access the data within the database 1515, a user 105 may make a user request via the user interface 1911 to the processor 1620. In an embodiment, the processor 1620 may grant or deny the request based on the permission level 2000 associated with the requesting user 2005, 2025, 2045. Only users 105 having appropriate user roles 2010, 2030, 2050 or administrator roles 2070 may access the data within the user profiles 1425. For instance, as illustrated in FIG. 20, requesting user 1 2005 has permission to view user 1 content 2015 and user 2 content 2035 whereas requesting user 2 2025 only has permission to view user 2 content 2035. Alternatively, user content 2015, 2035, 2055 may be restricted in a way such that a user may only view a limited amount of user content 2015, 2035, 2055. For instance, requesting user 3 2045 may be granted a permission level 2000 that only allows them to view user 3 content 2055 related to their specific financial institution but not user 3 content 2055 related to other financial institutions. In the example illustrated in FIG. 20, an administrator 2065 may bestow a new permission level 2000 on users so that it may grant them greater permissions or lesser permissions. For instance, an administrator 2065 may bestow a greater permission level 2000 on other users so that they may view user 3's content 2055 and/or any other user's content 2015, 2035, 2055. Therefore, the permission levels 2000 of the system 1800 may be assigned to users 105 in various ways without departing from the inventive subject matter described herein.

Figure 21:
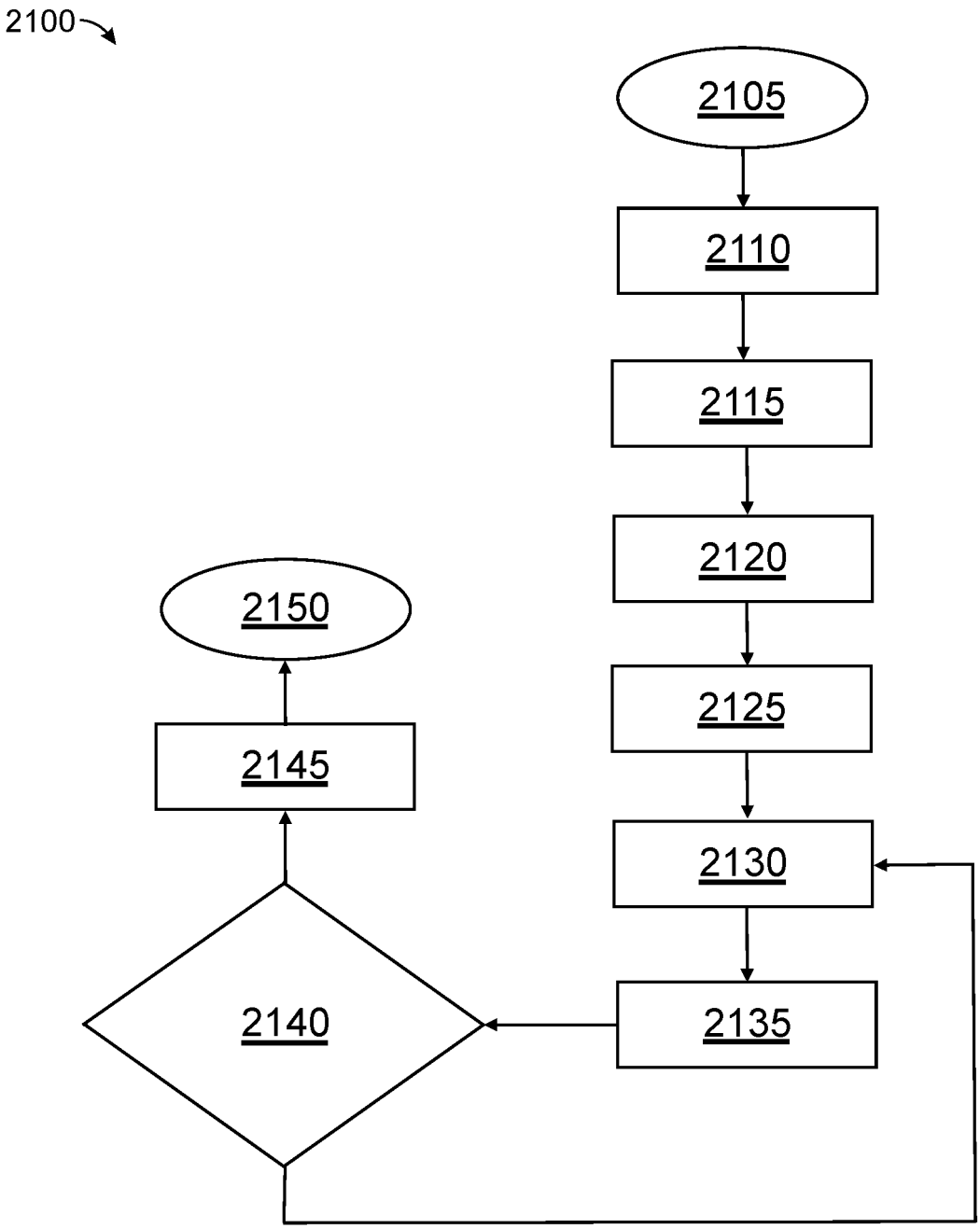
FIG. 21 is a flow chart illustrating certain method steps of a method embodying features consistent with the principles of the present disclosure.

FIG. 21 provides a flow chart 2100 illustrating certain, preferred method steps that may be used to carry out the method of using a mobile exercise device 100. Step 2105 indicates the beginning of the method. During step 2110, a user 105 may obtain a securing element 607 and mobile exercise device 100, which may or may not comprise a top-carrying arm 70 or mechanical arm 50, 60. In a preferred embodiment, the mobile exercise device 100 comprises an adjustable mechanical arm that a user 105 may use with a gaming system 1810. Once the mobile exercise device 100 has been obtained by a user 105, the user 105 may secure the mobile exercise device 100 to their person during step 2115. In a preferred embodiment, the straps of the harness may be used to secure the mobile exercise device 100 about the shoulders and a belt may be used to secure the mobile exercise device 100 about the waist, as illustrated in FIGS. 1A and 1B. The mobile exercise device 100 is preferably secured in a way such that the harness and backplate assembly do not move about the user 105 once secured to the user's body.

During step 2120, the user 105 may secure the securing element 607 to their arms and/or hands. Once the securing element 607 is in place, the user 105 may attach the resistance elements 606 of the mobile exercise device 100 to the securing element 607 during step 2125. In some embodiments, the user 105 may adjust the tension of the resistance element 606 by manipulating a resistance element adjustment mechanism 80. During step 2130, the user 105 may adjust the position of the bottom-carrying arm 40. In embodiments comprising a mechanical arm and/or top-carrying arm, the user 105 may also adjust the angle of said mechanical arm and/or top-carrying arm. During step 2135, the user 105 may perform a query to determine if the position of the bottom-carrying arm 40 is the desired position. Based on the results of the query, the user 105 may take an action during step 2140. If the user 105 determines that the position of the bottom-carrying arm 40 is not the desired position, the user 105 may return to step 2130. If the user 105 determines that the bottom-carrying arm 40 is in the desired position, the user 105 may perform physical activity using the resistance provided by the resistance elements 606 during step 2145. Once the user 105 has finished with the physical activity, the user 105 may proceed to terminate method step 2150.

Figure 22:
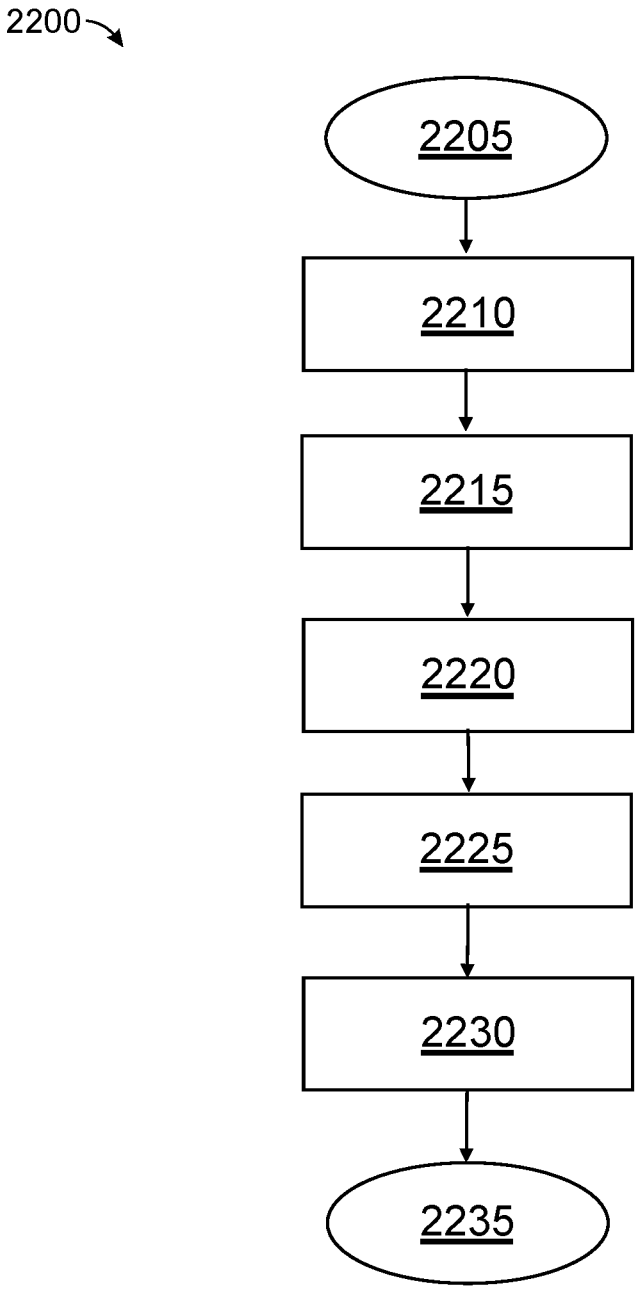
FIG. 22 is a flow chart illustrating certain method steps of a method embodying features consistent with the principles of the present disclosure.

FIG. 22 provides a flow chart 2200 illustrating certain, preferred method steps that may be used to carry out the method of using a mobile exercise device 100 with a gaming system 1810. Step 2205 indicates the beginning of the method. During step 2210, the processor 1620 may operably connect the mobile exercise device 100 with a gaming system 1810, wherein a control board 1805B of the mobile exercise device 100 is configured to communicate with said processor 1620. During step 2215, the processor 1620 may determine an action of a user 105 within a digital environment 1900. Based on the action determined by the processor 1620, the processor 1620 may send instructions to the control board 1805B during step 2220, wherein said instructions pertain to an amount of tension that said be applied to said resistance elements 606. The control board 1805B may process said instructions during step 2225 and subsequently send a computer readable signal to an actuator 1805A of said mobile exercise device 100 during step 2230. The actuator 1805A is operably connected to the resistance element adjustment mechanism 80 so that it may adjust the tension of the resistance elements 606 based on the information within the computer readable signal. In a preferred embodiment, the actuator 1805A replaces the knob of the resistance element adjustment mechanism 80 illustrated in FIGS. 12 and 13. Once the actuator 1805A has adjusted the tension based on the information within the computer readable signal, the system 1800 may proceed to the terminate method step 2235.

The subject matter described herein may be embodied in systems, apparati, methods, and/or articles depending on the desired configuration. In particular, various implementations of the subject matter described herein may be realized in digital electronic circuitry, integrated circuitry, specially designed application specific integrated circuits (ASICs), computer hardware, firmware, software, and/or combinations thereof. These various implementations may include implementation in one or more computer programs that may be executable and/or interpretable on a programmable system including at least one programmable processor, which may be special or general purpose, coupled to receive data and instructions from, and to transmit data and instructions to, a storage system, and at least one peripheral device.

These computer programs, which may also be referred to as programs, software, applications, software applications, components, or code, may include machine instructions for a programmable processor, and may be implemented in a high-level procedural and/or object-oriented programming language, and/or in assembly machine language. As used herein, the term "non-transitory computer-readable medium" refers to any computer program, product, apparatus, and/or device, such as magnetic discs, optical disks, memory, and Programmable Logic Devices (PLDs), used to provide machine instructions and/or data to a programmable processor, including a non-transitory computer-readable medium that receives machine instructions as a computer-readable signal. The term "computer-readable signal" refers to any signal used to provide machine instructions and/or data to a programmable processor. To provide for interaction with a user, the subject matter described herein may be implemented on a computer having a display device, such as a cathode ray tube (CRD), liquid crystal display (LCD), light emitting display (LED) monitor for displaying information to the user and a keyboard and a pointing device, such as a mouse or a trackball, by which the user may provide input to the computer. Displays may include, but are not limited to, visual, auditory, cutaneous, kinesthetic, olfactory, and gustatory displays, or any combination thereof.

Other kinds of devices may be used to facilitate interaction with a user as well. For instance, feedback provided to the user may be any form of sensory feedback, such as visual feedback, auditory feedback, or tactile feedback; and input from the user may be received in any form including, but not limited to, acoustic, speech, or tactile input. The subject matter described herein may be implemented in a computing system that includes a back-end component, such as a data server, or that includes a middleware component, such as an application server, or that includes a front-end component, such as a client computer having a graphical user interface or a Web browser through which a user may interact with the system described herein, or any combination of such back-end, middleware, or front-end components. The components of the system may be interconnected by any form or medium of digital data communication, such as a communication network. Examples of communication networks may include, but are not limited to, a local area network ("LAN"), a wide area network ("WAN"), metropolitan area networks ("MAN"), and the internet.

The implementations set forth in the foregoing description do not represent all implementations consistent with the subject matter described herein. Instead, they are merely some examples consistent with aspects related to the described subject matter. Although a few variations have been described in detail above, other modifications or additions are possible. In particular, further features and/or variations can be provided in addition to those set forth herein. For instance, the implementations described above can be directed to various combinations and subcombinations of the disclosed features and/or combinations and subcombinations of several further features disclosed above. In addition, the logic flow depicted in the accompanying figures and/or described herein do not necessarily require the particular order shown, or sequential order, to achieve desirable results. It will be readily understood to those skilled in the art that various other changes in the details, devices, and arrangements of the parts and method stages which have been described and illustrated in order to explain the nature of this inventive subject matter can be made without departing from the principles and scope of the inventive subject matter.

What is claimed is:

1. A system for performing exercise comprising:

a harness having a textile component, backplate, and at least one strap, wherein said at least one strap secures said harness to a user, resistance elements secured to said harness, a first bottom-carrying arm operably connected to said harness, wherein said first bottom-carrying arm is configured to swivel about said harness, a second bottom-carrying arm operably connected to said harness, wherein said second bottom-carrying arm is configured to swivel about said harness, a first top support operably connected to said harness, a second top support operably connected to said harness, and at least one securing element comprising an attachment element, wherein an attachment element of said resistance elements is configured to secure to said attachment element of said at least one securing element.

2. The system of claim 1, wherein said resistance elements are a spring and pulley system, wherein said spring and pulley system comprises a wire spool assembly connected to a control system.

3. The system of claim 2, wherein said control system comprises a gear and worm gear assembly, wherein said gear and worm gear assembly are mounted to said backplate of said harness, wherein rotating a main axle of said gear and worm gear assembly rotates a spring and adjusts tension of said spring and pulley system.

4. The system of claim 3, wherein a pulley of said spring and pulley system is mounted on a hook shaft and connected to a main axle, wherein said hook shaft and main axle rotate together through a ball bearing.

5. The system of claim 1, further comprising a first mechanical arm removably secured to said first top support and a second mechanical arm removably secured to said second top support, wherein said resistance elements are moveably secured to said first mechanical arm and said second mechanical arm, wherein said first mechanical arm and said second mechanical arm are configured to swivel about said first top support and said second top support.

6. The system of claim 5, further comprising flexible wheels of said first mechanical arm and said second mechanical arm, wherein said flexible wheels are configured to act as guides for a tensioned cable of said resistance elements.

7. The system of claim 1, further comprising a first top-carrying arm removably secured to said first top support and a second top-carrying arm removably secured to said second top support, wherein said resistance elements are moveably secured to said first top-carrying arm and said second top-carrying arm, wherein said first top-carrying arm and said second top-carrying arm are configured to swivel about said first top support and said second top support.

8. The system of claim 7, further comprising flexible wheels of said first top-carrying arm and said second top-carrying arm, wherein said flexible wheels are configured to act as guides for a tensioned cable of said resistance elements.

9. The system of claim 1, further comprising a first extender tube configured to removably secured to said first bottom-carrying arm and a second extender tube configured to removably secured to said second bottom-carrying arm, wherein said first bottom-carrying arm and said second bottom-carrying arm are secured via a plurality of holes and a locking pin, wherein said plurality of holes of said first extender tube align with said plurality of holes of said first bottom-carrying arm, wherein said plurality of holes of said second extender tube align with said plurality of holes of said second bottom-carrying arm.

10. The system of claim 1, further comprising an actuator that is operably connected to a control board and said resistance elements, wherein said actuator manipulates said resistance elements based on instructions received from said control board in order to adjust resistance applied by said resistance elements.

11. The system of claim 10, further comprising a processor operably connected to said control board and a non-transitory computer-readable medium of a virtual reality headset, wherein said non-transitory computer-readable medium contains instructions stored thereon, which, when executed by said processor, cause said processor to perform operations comprising:

determining an action of said user within a virtual reality application of said virtual reality headset, determining a resistance for said action, and transmitting resistance instructions to said control board based on said action and said resistance, wherein said resistance instructions instruct said actuator to adjust said resistance based on said action.

12. A system for performing exercise while gaming comprising:

a harness having a textile component, backplate, and at least one strap, wherein said at least one strap secures said harness to a user, a resistance element secured to said harness, a bottom-carrying arm operably connected to said harness, wherein said bottom-carrying arm is configured to swivel about said harness, a top support operably connected to said harness, an actuator that is operably connected to said resistance element, a control board operably connected to said actuator, a gaming system operably connected to said control board, wherein a gaming application of said gaming system immerses a user within a digital environment in which said user may take an action, a processor operably connected to said control board, gaming system, and said actuator, and a non-transitory computer-readable medium coupled to said processor, wherein said non-transitory computer-readable medium contains instructions stored thereon, which, when executed by said processor, cause said processor to perform operations comprising:

determining said action of said user within said digital environment, determining a resistance for said action within said digital environment, and transmitting resistance instructions to said control board based on said action and said resistance, wherein said resistance instructions instruct said actuator to adjust said resistance based on said action.

13. The system of claim 12, wherein said resistance element is a spring and pulley system, wherein said spring and pulley system comprises a wire spool assembly connected to a control system, wherein said control system comprises a gear and worm gear assembly, wherein said gear and worm gear assembly are mounted to said backplate of said harness, wherein rotating a main axle of said gear and worm gear assembly rotates a spring and adjusts tension of said spring and pulley system.

14. The system of claim 13, wherein a pulley of said spring and pulley system is mounted on a hook shaft and connected to a main axle, wherein said hook shaft and main axle rotate together through a ball bearing.

15. The system of claim 12, further comprising a mechanical arm removably secured to said top support, wherein said resistance element is moveably secured to said mechanical arm, wherein said mechanical arm is configured to swivel about said top support.

16. The system of claim 12, further comprising a top-carrying arm removably secured to said top support, wherein said resistance element is moveably secured to said top-carrying arm, wherein said top-carrying arm is configured to swivel about said top support.

17. A method for exercising in virtual reality comprising steps of:

obtaining a virtual reality headset, obtaining a mobile exercise system comprising a harness, bottom-carrying arm, top support, resistance element, and at least one securing element, configuring said mobile exercise system about a user's body, wherein said harness is secured about a torso of said user's body, wherein said at least one securing element is secured to an extremity of said user's body, wherein attachment elements of said resistance element are secured to said at least one securing element, obtaining a mechanical arm configured to removably secure to said top support, securing said mechanical arm to said top support, securing said resistance element to said mechanical arm, swiveling said mechanical arm about said top support to find a desired position, configuring said virtual reality headset about a head of said user's body, and interacting in a digital environment with said mobile exercise system to perform exercises.

18. The method of claim 17, further comprising additional steps of:

obtaining a top-carrying arm configured to removably secure to said top support, securing said top-carrying arm to said top support, securing said resistance element to said top-carrying arm, and swiveling said top-carrying arm about said top support to find a desired position.

19. The method of claim 17, further comprising additional steps of:

pairing said virtual reality headset with a control board of said mobile exercise system, opening a virtual reality application on said virtual reality headset, wherein actions taken by a user within said virtual reality application cause said virtual reality headset to transmit resistance instructions to said control board, wherein said control board transmits a computer readable signal to an actuator based on said resistance instructions, wherein said computer readable signal causes said actuator to adjust a level of resistance applied by said resistance element, and taking said actions within said virtual reality application.

* * * * *